US010602798B2

(12) United States Patent
Bell

(10) Patent No.: US 10,602,798 B2
(45) Date of Patent: Mar. 31, 2020

(54) FOOT AND TOE PROTECTION DEVICE

(71) Applicant: Felicia A. Bell, Riverdale, GA (US)

(72) Inventor: Felicia A. Bell, Riverdale, GA (US)

( * ) Notice: Subject to any disclaimer, the term of this patent is extended or adjusted under 35 U.S.C. 154(b) by 0 days.

(21) Appl. No.: 16/384,653

(22) Filed: Apr. 15, 2019

(65) Prior Publication Data

US 2019/0239594 A1 Aug. 8, 2019

Related U.S. Application Data

(60) Provisional application No. 62/659,689, filed on Apr. 18, 2018.

(51) Int. Cl.
*A43B 7/14* (2006.01)

(52) U.S. Cl.
CPC ..... *A43B 7/1425* (2013.01); *A43B 7/149* (2013.01)

(58) Field of Classification Search
CPC ..... A43B 7/1425; A43B 7/149
USPC ..... 36/25 R, 28, 23, 15, 16, 77 R, 80
See application file for complete search history.

(56) References Cited

U.S. PATENT DOCUMENTS 3,316,663 A * 5/1967 Neu ..... A43B 7/1425 36/71
3,845,576 A * 11/1974 Howland, Jr. ..... A43B 7/32 36/77 R
4,821,431 A * 4/1989 Rieffel ..... A43B 7/28 36/1
5,491,909 A * 2/1996 Darby ..... A43B 11/00 36/110
5,607,756 A * 3/1997 Yamauchi ..... A61F 5/14 442/6
5,906,007 A * 5/1999 Roberts ..... A41B 11/004 132/73
6,226,894 B1 * 5/2001 Bray, Jr. ..... A43B 3/108 12/142 T
6,493,965 B1 * 12/2002 Bathum ..... A43B 3/126 36/11.5
6,796,058 B2 * 9/2004 Pochatko ..... A43B 1/0081 36/102
7,847,143 B2 * 12/2010 Moramarco ..... A43B 3/102 128/112.1
8,240,066 B2 * 8/2012 Logan ..... A61F 5/0111 36/145
2002/0069558 A1 * 6/2002 Wilkinson ..... A43B 7/00 36/106
2007/0074334 A1 * 4/2007 Steel ..... A41B 11/004 2/239
2009/0100715 A1 * 4/2009 Broadley ..... A43B 5/12 36/102

(Continued)

*Primary Examiner* — Justin M Jonaitis

(57) ABSTRACT

This invention generally relates to the field of attachment devices and systems, and more particularly, but not by way of limitation, to a device and method for keeping toes inside the straps of open toe style shoes or sandals; minimizing the risk of developing irritations such as corns, callous, and bunions; protecting the toes with preexisting irritations such as corns, callous, and bunions; prevent the feet from sliding in the shoes. The present invention gives a smooth look to the foot and enjoying the ability of wearing open toe style shoes or sandals with a toe support brace on each side of the foot. There are many woman that cannot wear open toe style shoes or sandals due to the imperfections of their feet and toes, now they can.

10 Claims, 18 Drawing Sheets

(56) References Cited

U.S. PATENT DOCUMENTS

| | | | | |
|---|---|---|---|---|
| 2014/0352174 | A1* | 12/2014 | Benkovic | A43B 1/0081 36/83 |
| 2015/0196089 | A1* | 7/2015 | Thomsen | A43B 7/145 36/43 |

* cited by examiner

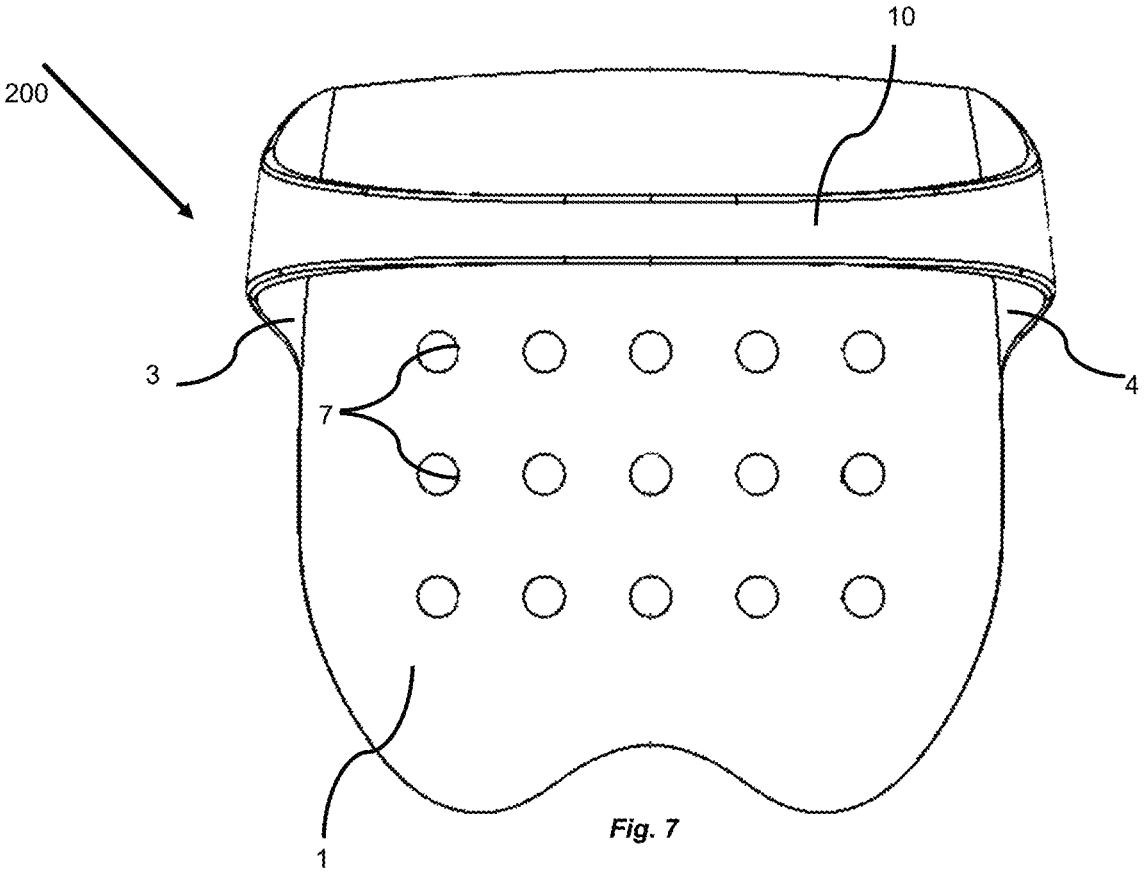
*Fig. 7*
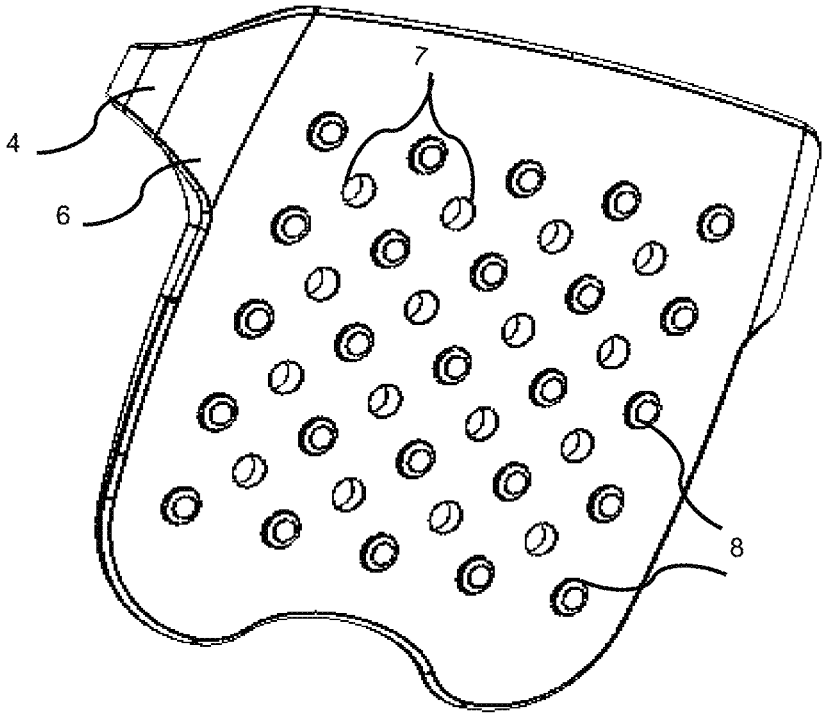
*Fig.* 8

*Fig.* 19

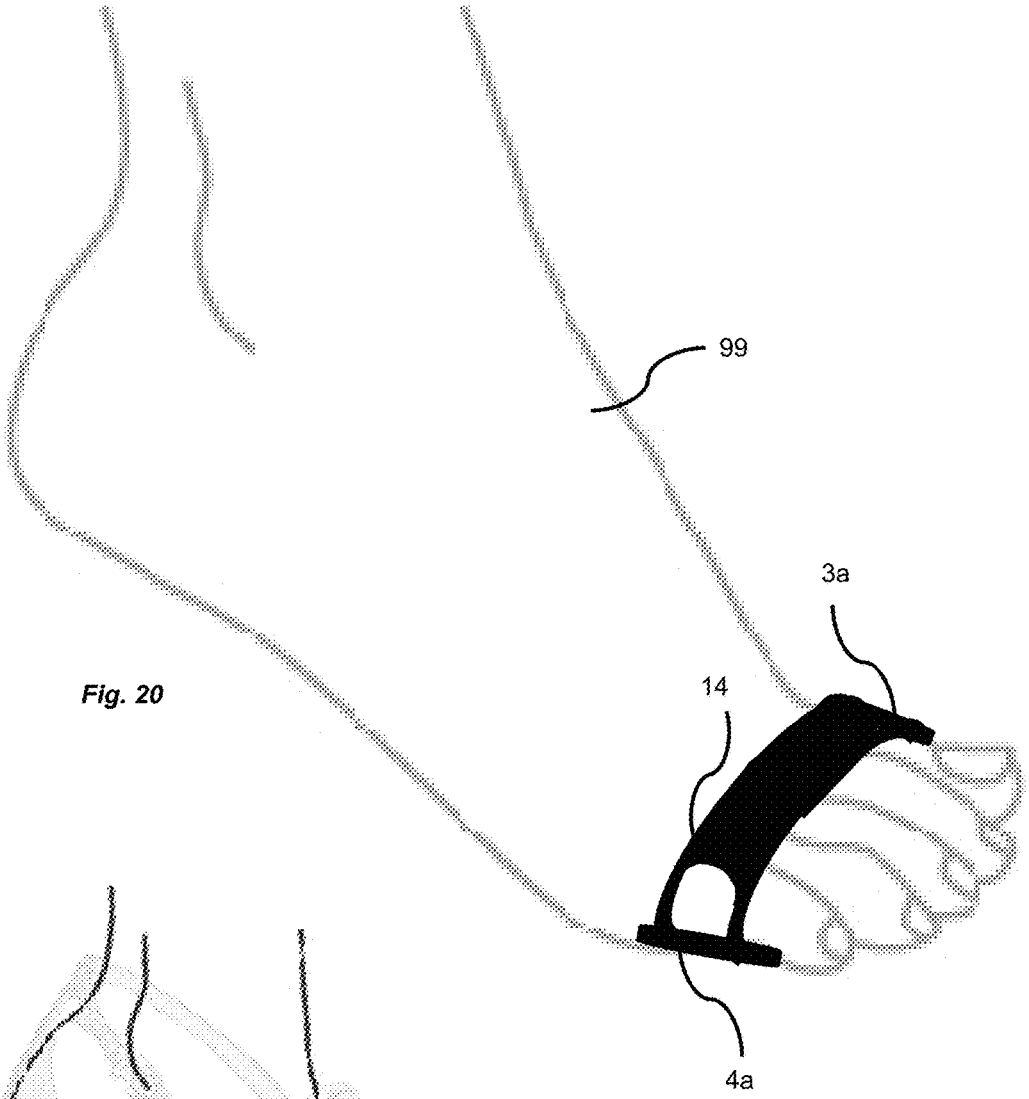
*Fig. 20*
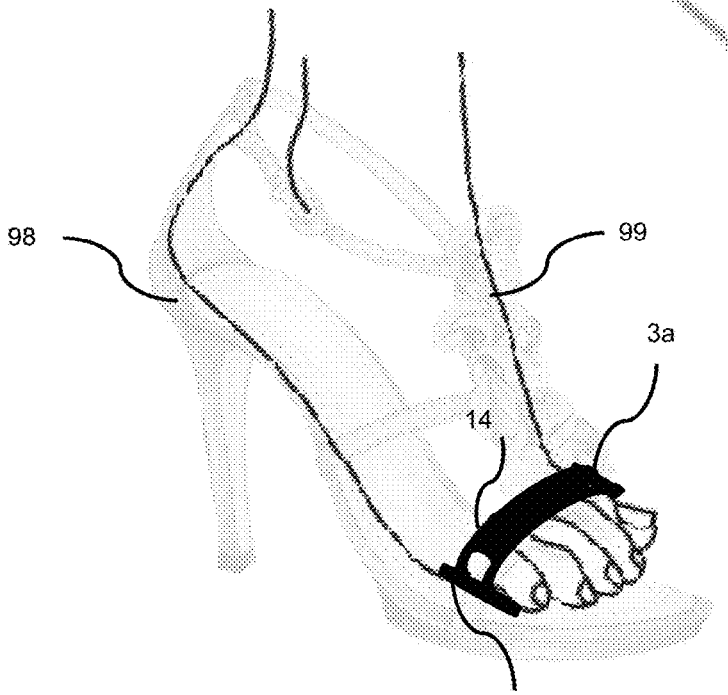
*Fig.* 21

*Fig.* 26

FOOT AND TOE PROTECTION DEVICE

DESCRIPTION OF THE RELATED PRIOR ARTS

The following patents have been researched to contrast the differences and improvements of the present invention relating to toe devices, to past inventions for toe devices. The research concludes that while various toe ornaments were designed for toe cosmetics and fashion, and invented toe holders, none of the functions of these prior arts were to serve to keep the pinky toe within the boundaries of an open toe style shoes or sandals, while providing comfort, stabilization, and supports to prevent the pinky toe from protruding and bulging out of the side of the shoes or sandals, and to prevent the toes from overhanging the front of the shoes or sandals.

U.S. Pat. Nos. 7,335,178 B2 and 7,922,681 B2 are patents for a protective device against frictional irritation due to wearing thong-type sandals and other footwear. Their patent is a device which gives protection from frictional injury to the web space between toes due to the wearing of thong-type sandals or other similar footwear. The device is comprised of a flat, flexible, medically inert, and preferably transparent plastic material which is configured in a shape which has a plantar base portion which fits under the toes and on the bottom of the foot, stabilizing the device from moving, a web spacer portion which fits between the toes and provides protection from frictional injury, and a dorsal flap portion which anchors the device to the top side of the foot.

U.S. Pat. No. 7,735,243 is for a footwear toe pad. Their patent is for a self-adhesive toe pad for open toe sandals and the like that have a thong strap that is engaged between the big toe and pointer toe. The toe pad is of a contoured flat base with a curvilinear upstanding strap engagement portion that is of a dimensional thickness that pads the toe contact areas for improved comfort during use.

U.S. Pat. No. 8,806,781 is for a device for wearing thong-type sandals. Their patent is for a device that engages a stem of a sandal and, in turn, allows the position of toes and web space of a user around the device. The device is constructed to ease the frictional and compression forces on the user by the stem.

In contrast to U.S. Pat. Nos. 7,335,178 B2, 7,922,681 B2, 7,735,243, and 8,806,781, the present invention addresses, but is not limited to only protecting the webbed spacing between the big toe and the second toe. The present invention is an accessory primarily for the pinky toes; however, an alternate embodiment described herein does offer protection for said webbed spacing. The design of the present invention does not include the use of any adhesives to attach the device to the foot or footwear, as specifically described in U.S. Pat. No. 7,735,243.

U.S. Pat. No. 3,316,663 A is for an anti-sliding support for footwear. Their patent is for an anti-sliding support for footwear, more particularly a device which may be mounted in an article of footwear individually or in conjunction with foot supporting or cushioning devices to prevent the foot from sliding forward in the footwear.

In contrast to U.S. Pat. No. 3,316,663 A, the present invention addresses, but is not limited to only an anti-sliding support for the footwear. The present invention is an accessory primarily for the pinky toes; however, described herein, the present invention does provide non-skid protection to prevent the foot from sliding when the invention is in use.

U.S. Pat. No. 2,633,129 A is for a foot cushioning appliance. Their patent is for a foot cushioning appliance, more particularly to an appliance highly desirable for disposition beneath the plantar surface of the foot; especially in the region of the metatarsal arch.

In contrast to U.S. Pat. No. 2,633,129 A, the present invention addresses, but is not limited to only being a foot cushioning appliance. The present invention is an accessory primarily for the pinky toes; however, described herein, the present invention does provide added comfort and cushioning for the foot.

U.S. Pat. No. 6,014,822 A is for a foot cover inserts for sandals. This expired patent was for a foot cover insert adapted to be slid over a wearer's foot and to cover the instep and sides of the foot for keeping feet inside straps of sandal shoes. The foot cover insert having an upper consisting of a clear, smooth, firm, pliable, vinyl material; and a flat sole consisting of a thin cork material or a fabric material that has a heavy grain. The upper and sole joined together at their edges to form a tubular shaped member with an enlarged first opening to permit the insert to be slid over the foot of the wearer, and an enlarged second opening at the front of the tubular member. The insert adapted to cover only the portion of the foot between the toes and the instep.

In contrast to the expired U.S. Pat. No. 6,014,822 A, the present invention addresses, but is not considered a foot cover. The present invention is an accessory primarily for the pinky toes; however, described herein, the present invention does provide alternate embodiments that provide some covering of the top of the foot; however, the present invention is designed to be transparent when in use and still allowing the user to add additional fashionable and cosmetic attributes, if so desired, to fit their style and attire.

U.S. Pat. No. 5,063,692 A is for a footwear and insole pad. This expired patent was for a footwear and an insole pad, in which an arch extrusion being raised toward the outside thereof is provided at an outer periphery corresponding to an outside arch on the upper surface of an insole of the footwear or on the upper surface of the insole pad, so that the shift of weight rested on a foot upon walking toward the outside upon walking is supported by the arch extrusion and the weight rested on the foot is gathered to the center of a body.

In contrast to the expired U.S. Pat. No. 5,063,692 A, the present invention addresses, but is not limited to only being an insole pad. The present invention is an accessory primarily for the pinky toes; however, described herein, the present invention does provide added comfort and cushioning for the arch of the foot when in use with footwear.

U.S. patent application 20150196089 A1 is for a shoe insert. This abandoned patent application was for a shoe insert to inhibit a small toe from propagating outward from a sandal style or open style shoe design. The shoe insert further includes a body that is planar in manner and being arcuate in shape. The body has an outer surface and an inner surface wherein the outer surface includes an adhesive that secures the body to a portion of a shoe. The body further includes a securing portion that is operable to extend underneath a portion of the foot of a user subsequent the user placing their foot having the shoe insert disposed therein. The body of the shoe insert is manufactured from a transparent soft rubber material.

In contrast to the abandoned U.S. patent application 20150196089 A1, the present invention offers an improved solution to preventing the pinky toe from protruding and bulging out of the side of the shoes or sandals, and to prevent the toes from overhanging the front of the shoes or sandals. The present invention is not designed to be a shoe insert but rather a foot accessory primarily for the pinky toes. The design of the present invention does not include the use of any adhesives to attach the device to the foot or footwear, as specifically described in this abandoned U.S. patent application 20150196089.

U.S. patent application 20040025377 A1 is a footwear insert to prevent foot sliding. This abandoned patent application was for an insert that prevents a foot from slipping while remaining thin enough to be hidden when worn with open toed footwear, shoes, or sandals. When used with open toed footwear, the insert prevents a person's toes from extending over a front edge of the footwear. The insert may also be used for men and women's footwear, and it may be made in a variety of colors and shapes. The insert may be made out of a number of different materials that provide traction to inhibit foot sliding in footwear.

In contrast to the abandoned U.S. patent application 20040025377 A1, the present invention addresses, but is not limited to only a device to prevent foot slippage. The present invention is an accessory primarily for the pinky toes; however, described herein, the present invention does provide non-skid protection to prevent the foot from sliding when the invention is in use.

U.S. patent applications 2015201701 A1, is for a foot protection device for insertion into a sandal to minimize pressure and irritations on the top and front portions of the foot. This abandoned patent application was for a foot protection device for insertion into a sandal, the sandal having a plurality of straps that run across the front and top area of the foot that may apply excess pressure and cause irritations to the foot.

In contrast to the abandoned U.S. patent application 2015201701 A1, the present invention addresses, but is not limited to only being a foot protection device for minimizing pressure and irritations on the foot; however, the present invention offers an improved solution to preventing the pinky toe from protruding and bulging out of the side of the shoes or sandals, and to prevent the toes from overhanging the front of the shoes or sandals. The present invention is not designed to be a shoe insert but rather a foot accessory primarily for the pinky toes. The alternate embodiments can also serve as a means to relieving the pressures and irritations caused by the straps of the footwear or the footwear itself.

The following prior arts were viewed and found to be out of scope and spirit of the present invention with no contrasting attributes found in these Patents and Applications:

U.S. Pat. No. 4,631,841 A is a shoe insert device comprises a pad of cushioning material having a forward portion for cushioning the forefoot and a rearward arched portion which is thickened and shaped to conform substantially to the arch of a user's foot. The rearward portion terminates short of the heel region of the foot.

U.S. Pat. No. 4,928,404 A is a heel cushion composed of silicone rubber having a region which can be centrally or eccentrically located directly below the heel spur and composed of a softer silicone rubber than the balance of the heel cushion so that in heel regions subjected to higher pressure, that higher pressure will be absorbed by the softer material and the pressure throughout the back bottom part of the foot will be more uniform.

U.S. Pat. No. 7,805,860 B2 is a footwear having independently articulable toe portions. Their patent includes a sole and an upper where the sole and the upper delimit individual toe portions configured to receive, retain, and allow independent articulation of corresponding individual toes of a foot inserted in the footwear and where the sole includes an extension portion which extends upwardly around at least a portion the foot.

U.S. Pat. No. 9,387,359 B2 is for a foot-therapy and toe-aligning device. Their patent is for an exercise tool. More particularly, it is a therapy and exercise tool specifically devised as a foot-therapy and toe-aligning device to align, separate, and stretch toes.

U.S. Pat. No. 5,496,612 A is for a shoe adornment. This expired patent was for a shoe adornment in the form of a thin sheet-like base which is mounted on the lower surface and on the upper surface of the base is mounted an ornament.

U.S. Pat. No. 3,712,271 A is for a toe holder. This expired patent was for a device used by sunbathers to hold their feet together by means which encircles the large toes or some other portions of each foot.

U.S. patent application 20020121030 A1 is a thong footwear cushion. This abandoned patent application was for a cylindrically-shaped cushion for attachment around the straps of footwear having straps which cushion is designed to be worn between the big toe and the pointer toe of a user. The cylindrically shaped cushion has an inner fabric and an outer fabric design. The cushion has a split running vertically through which allows the cushion to be opened at so that it can be placed around the straps of the footwear.

U.S. patent application 20150119782 A1 is for a buddy hug. This abandoned patent application was for a toe wrap designed toe cast that replaces the traditional method of using tape to stabilize and immobilize a broken toe. The toe wrap wraps around or "hugs" the injured toe and its neighboring toe.

U.S. patent application 20060243291 A1 is for a toe spacers and methods for making them. This abandoned patent application was for a toe spacer that includes an elongate base and a plurality of spacer elements extending transversely from the base. One or more of the spacer elements has a shape corresponding to an aesthetic object, and a decorative pattern is applied to the spacer elements that depicts the aesthetic object.

U.S. patent application 20070074334 A1 is for a toe spacer sock and corrective footwear. This abandoned patent application was for a sock that contains built-in cushions or spacers to correct or protect the toes, or to provide the wearer better comfort. The cushions or spacers may be retained between the toes in a tube, formed integrally with the sock, which is everted to a position between adjacent toes.

The Australian patent applications AU2007200015 AI and AU2007100787 A4 for a foot accessory are lapsed and ceased, respectively. These patents are for a foot accessory adapted to apply localized, motion-generated pressure to the solar plexus of the sole of a foot, in order to produce a therapeutic effect in the user.

The Australian patent application AU 2016204039 AI is for a toe correction assistant toe straightening. Their patent is a device to correct and straighten toes and alignment. The invention is aimed and directed towards children (but not restricted to) who suffer from crossover toe, overlapping toes, underlapping toes, curly toes or hammer toe.

The Japanese patent JPH08243119 is for a foot band for hallux valgus. Their patent is for a foot band for hallux valgus capable of preventing the foot band from coming off or coming loose when a person with hallux valgus wears it and walking for a long time without generating a pain or fatigue when the person puts on the shoes.

The Canadian patent CN205757575 is for a breathable insole shoe pad which includes antibiotic screen cloth layer, memory foam layer and the cotton layer the shoe pad has the antibiotic deodorization ability of strong effect, thoroughly wet perspire ability and good buffer capacity, can alleviate greatly in addition to the impact force and promotes degree comfortable and easy to wear greatly, is applicable to flat-feet's correction simultaneously.

The Canadian patent CN202341016U is for a toe protecting pad. Their patent application was for a utility model toe protecting pad, which comprises a bottom toe pad, toe grooves and toe gap partitioning pads, wherein the toe grooves are partitioned by the toe gap partition pads to be distributed on the bottom toe pad.

BACKGROUND OF THE INVENTION

Proper fit is always an issue with women's shoes. Women frequently forego comfort for the sake of style. Not only are such stylish shoes uncomfortable, they can cause callous formations, bruises, and cuts to the feet and toes due to an improper fit and the design cut of certain style of shoes.

With regard to proper fitting of a shoe, one of the most common women's shoe fitting issues relate to the fit around the toes and the outsides of the foot. While shoe manufacturers offer the standard widths of narrow, medium, and wide such size gradation is insufficient to account for width variations within those categories. A woman's foot that fits a medium, for example, might still feel a painful rubbing on the toes, and going to the next width category is not their desired option or fit.

With regard to shoe style, the above problems can be exacerbated by certain popular styles of women's shoes including flats, pumps, high heels, and particularly, open toed shoes and sandals.

Women often forgo the fashionable style of open toed shoes and sandals and settled for enclosed footwear to hide or eliminate the ill-fit of the more fashionable footwear that reveals the overhanging, protruding, and bulging out of the side of the shoes or sandals.

Prior art solution to the above identified problems include: a. endure the pain—the majority of women just simply endure the pain, b. wear less fashionable shoes—women can wear less fashionable shoes than they otherwise would desire, c. local coverage—women can use socks or products such as Band-aids® or Mole-skin® that use an adhesive base, are unattractive, and cover only a small portion of the troubled area and they do not reliably stay in place and are not reusable, and d. providing a protective layer between the problem areas (e.g. side and top around the toes) of the foot and the shoe material.

The continuing concern among consumers who wear uncomfortable or ill-fitting shoes, is that the straps of a shoe or sandal may cause discomfort to the wearer and there is ever growing concern to look for an invention that prevents the pinky toe from protruding and bulging out of the side of the shoes or sandals, and prevent the toes from overhanging the front of the shoes or sandals, and provides enhanced comfort and support while walking and standing. Shoe insoles and comfort padding are often used to address the specific needs of an individual in connection with this problem; however, these remedies have not totally solved the problem. Thus, the wearer is impeded from the general use of particular shoes in everyday living to keep up with the ever-changing styles.

The goal of any foot or toe comfort device is to promote an eased condition such that the foot and toes are maintained in a comfortable position, and to deter points of external pressure or stress caused by certain shoe sections that come into direct contact with the wearer's foot. Moreover, a further goal of these products is to facilitate the function of the foot as it interacts and engages with the wearer's shoe while the wearer is in a seated or idle position, and also if the wearer is in motion or engaged in walking or some other activity experienced in the regular course of daily life.

What is needed is an invention that addresses substantially all of the trouble area for the protruding toes where such invention can be transparent or natural in color to minimize its impact on the style of the shoe or flashy or have its own design that can add trendy elements or contrasting color. Such an invention for the pinky toe would be designed as to not alter the look of the footwear with the many envisioned styles.

There are some foot devices that address the toes fitting inside of the shoe and some with the aid of tape and other adhesive solutions that attaches the device to the shoe or foot; however, there is no other prior art or device that is separate from the shoe that can be worn on the foot in many styles, and have the effect of keeping toes within the boundaries of an open toe style shoes or sandals, yet giving the appearance of no device being worn.

Thus there remains a need to present to women and men alike, who have imperfect feet, to be able to wear open toe style shoes or sandals, a product that can serve the purpose to eliminate the overhanging, protruding, and bulging out of the side of the footwear.

Accordingly, a need exists for a new and improved foot device that specifically eliminates the pinky toe from protruding and bulging out of the side of the shoes or sandals, and prevent the toes from overhanging the front of the shoes or sandals, and provides enhanced comfort and support to the wearer's foot while walking and standing. In addition, there is a need for a foot and toe protection device that provides better and more advantageous overall results in terms of extending the length of time a wearer is able to comfortably wear open toe style shoes or sandals. It is a general objective of the present invention to provide such a foot and toe protection device.

The present invention is an improved foot accessory used to comfortably realign widespread and scattered toes in the shoes and to eliminate the pinky toe from protruding and bulging through the straps of the open toe style shoes or sandals, and prevent the toes from overhanging the front of the shoes or sandals.

It is the objective of the present invention to provide a foot and toe protection device, wherein the foot and toe protection device is operable to be secured on the foot that is inserted into an open toe style shoes and sandals.

Another objective of the present invention is to provide a foot and toe protection device for an open toe style shoes and sandals that is secured on the foot within the shoe such that the foot and toe protection device is adjacent to the wearer's foot.

Still a further objective of the present invention is to provide a foot and toe protection device operable to be secured on the foot within an open toe style shoes and sandals that is generally transparent.

Yet another objective of the present invention is to provide a foot and toe protection device that can be worn numerous times before becoming worn out and therefore, does not require consistent replacement.

An additional objective of the present invention is to provide a foot and toe protection device for an open toe style shoes and sandals that is adjacent to the pinky toe of a wearer wherein the foot and toe protection device functions to prevent the pinky toe from protruding and bulging from the shoe.

A further objective of the present invention is to provide a foot and toe protection device for an open toe style shoes and sandals that is manufactured from a flexible material.

To the accomplishment of the above and related objectives the present invention may be embodied in the forms illustrated in the accompanying drawings. Attention is called to the fact that the drawings are illustrative only. Variations are contemplated as being a part of the present invention, limited only by the scope of the claims.

SUMMARY OF THE INVENTION

One popular style of shoe for women are open toe style shoes and open toe sandals. These style shoes are made for both casual and formal wear and worn with frequency by women. Many open toe style shoes and open toe sandals do not have a closed design around the front and forward sides of the foot. The design of said footwear includes a plurality of straps or similar form of material that extend from one side of the shoe to the opposing side to form an open-style shoe wherein the foot is surrounded or encircled by the strap design of the shoe but also wherein there are voids intermediate the straps of the shoe, this is generally where the pinky toe will be found to protrude or bulge out from the shoe. Those skilled in the art understand there are numerous designs of open toe style shoes and open toe sandals.

One problem with open toe style shoes and sandals is the location of the straps often do not provide the securing of the pinky toes of the user. In particular, many designs of open toe style shoes and open toe sandals are such that the pinky toe of the user is often left exposed and unprotected by the design of the shoe. Due to variations in the size of feet, many wearers of the open toe style shoes and open toe sandals will have an issue with their pinky toe protruding and bulging out from the shoe. This is could be very uncomfortable for the user and additionally provides a possibility for damage to the pinky toe and pinky toenail of the wearer during the use of these particular styles of shoes.

Consequently, there is a need for a foot and toe protection device that is operably to be secured on the foot within an open toe style shoe and sandal that functions to prevent the pinky toe of the wearer from protruding and bulging out from the shoe in order to maintain the toes of a user within the shoe.

Some of the objectives and advantages of the present invention will now be set forth in the following description, while other objectives and advantages of the invention may be obvious from the description, or may be learned through practice of the invention.

Broadly speaking, a principle objective of the present invention is to allow people to wear any style of shoe without pain to the pinky toes in a fashionable way.

Additional objectives and advantages of the present invention are set forth in the detailed description herein or will be apparent to those skilled in the art upon reviewing the detailed description. Also, it should be further appreciated that modifications and variations to the specifically illustrated, referenced, and discussed steps, or features hereof may be practiced in various uses and embodiments of this invention without departing from the spirit and scope thereof, by virtue of the present reference thereto. Such variations may include, but are not limited to, substitution of equivalent steps, referenced or discussed, and the functional, operational, or positional reversal of various features, steps, parts, or the like. Still further, it is to be understood that different embodiments, as well as different presently preferred embodiments, of this invention may include various combinations or configurations of presently disclosed features or elements, or their equivalents (including combinations of features or parts or configurations thereof not expressly shown in the figures or stated in the detailed description).

No adhesives or any other securing means other than the left and right side toe support braces are necessary in order to retain the device properly in position over the toes. Thus, there is no binding of the device against any part of the foot, the user, or the footwear. After an extremely short interval of time, the user is totally unaware of the presence of the invention. The lower surface of the metatarsal region of the foot fits comfortably over the toes support pad surface of the invention, and the invention will effectively provide comfort, especially to a wearer of high heel shoes, and eliminate the protruding and bulging out of the side of the shoes or sandals.

It will at once be apparent that the invention may be removed whenever desired and thoroughly sterilized or laundered without harm to the invention. In addition, it will be noted that the invention is economical in construction, and extremely long lived.

It will be understood that modifications and variations may be effected without departing from the scope of the novel concepts of the present invention.

Recognizing the need for the development of new and improved methods and products for relieving excess pressure and irritations of the protruding and bulging of the pinky toes, the present invention is generally directed to the needs set forth above and overcoming the problems with and the disadvantages exhibited by prior foot art, insoles, and padding.

In other possible embodiments of the present invention, the configuration of the foot and toe protection devices is further adapted so as to be transparent being manufactured from a suitable durable transparent material. More specifically but not by way of limitation, in a preferred embodiment the foot and toe protection device is manufactured from a transparent soft material that is of a elastomeric gel-like material.

In addition, the present invention can take the form of a method of forming a foot protection device when inserting the foot into a sandal.

Thus, there has been summarized above (rather broadly and understanding that there are other preferred embodiments which have not been summarized above) the present invention in order that the detailed description that follows may be better understood and appreciated.

Referring now to the drawings submitted herewith, wherein various elements depicted therein are not necessarily drawn to scale and wherein through the views and figure like elements are referenced with identical reference numbers, there is illustrated a foot and toe protection device constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", "alternate embodiment" and the like may indicate that the embodiment(s) of the invention so described may include a particular feature, structure or characteristic, but not every embodiment necessarily includes the particular feature, structure or characteristic.

The foot and toe protection device further includes an inner surface that is adjacent the exemplary pinky toe subsequent a user placing the said device on the foot and the foot into an exemplary open toe style shoe or sandal. In its preferred embodiment the said device is manufactured from a moldable material so as to allow conformity of the shape by a user for a particular open toe style shoe or sandal. Such a material will facilitate the maintenance of the shape of said device subsequent being secured within the exemplary open toe style shoe or sandal.

Those of ordinary skill in the art will better appreciate the features and aspects of such embodiments, and others, upon review of the remainder of the specification.

BRIEF DESCRIPTION OF THE DRAWINGS

A more complete understanding of the present invention may be had by reference to the following detailed description and appended claims when taken in conjunction with the accompanying drawings wherein:

The accompanying drawings illustrate referred embodiments of the present invention according to the best mode presently devised for making and using the instant invention, and in which:

FIG. 1 is a zoomed-in top perspective view of the present invention; and

FIG. 2 is a zoomed-in bottom perspective view of the present invention; and

FIG. 7 is a zoomed-in top perspective view of the present invention in an alternate embodiment having a strap across the top of the foot; and FIG. 8 is a zoomed-in bottom perspective view of the present invention in an alternate embodiment having a strap across the top of the foot.

FIG. 11 is a zoomed-in bottom perspective view of the present invention in an alternate embodiment having attachment buttons on the wings.

FIG. 20 is a perspective view of the present invention in an alternate embodiment having a wide band strap attached to the buttons on the side of the wing in use from the top of the right foot FIG. 21 is a perspective side view of the present invention in an alternate embodiment having a wide band strap attached to the buttons on the side of the wing in use on the right foot inserted into an open toe sandal.

DESCRIPTION OF THE PREFERRED EMBODIMENTS

Figure 1:
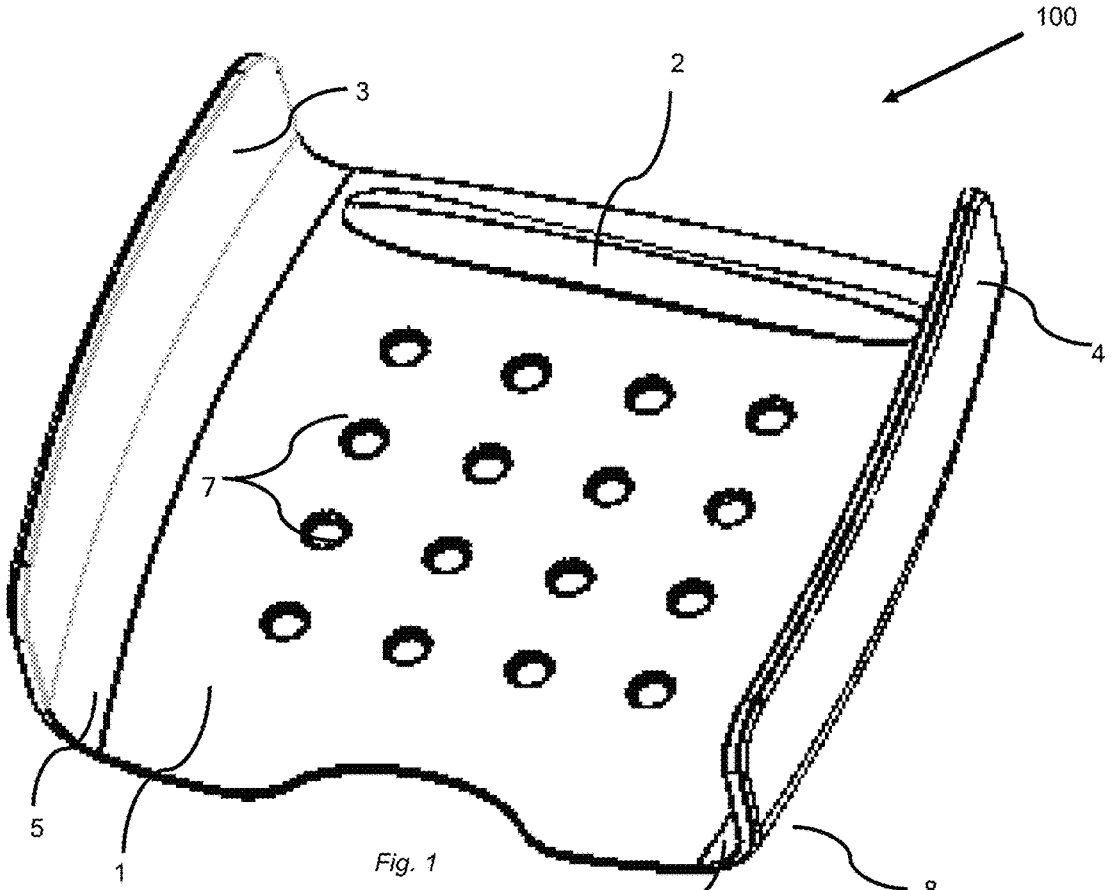
FIG. 1 and FIG. 2 is a zoomed-in perspective view of the present invention.

Reference now will be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used on another embodiment to yield a still further embodiment. Thus, it is intended that the present invention covers such modifications and variations as come within the scope of the appended claims and their equivalents. Other objectives, features, and aspects of the present invention are disclosed in or may be determined from the following detailed description. Repeat use of reference characters is intended to represent same or analogous features, elements or steps. It is to be understood by one of ordinary skill in the art that the present discussion is a description of exemplary embodiments only, and is not intended as limiting the broader aspects of the present invention.

This document includes headers that are used for place markers only. Such headers are not meant to affect the construction of this document, do not in any way relate to the meaning of this document nor should such headers be used for such purposes.

While the particulars of the present invention and associated technology may be more frequently described for use with women's shoes, the disclosed technology may also be used with men's shoes and children's shoes and in any fields having the problems addressed by the various embodiments of the invention.

Figure 2:
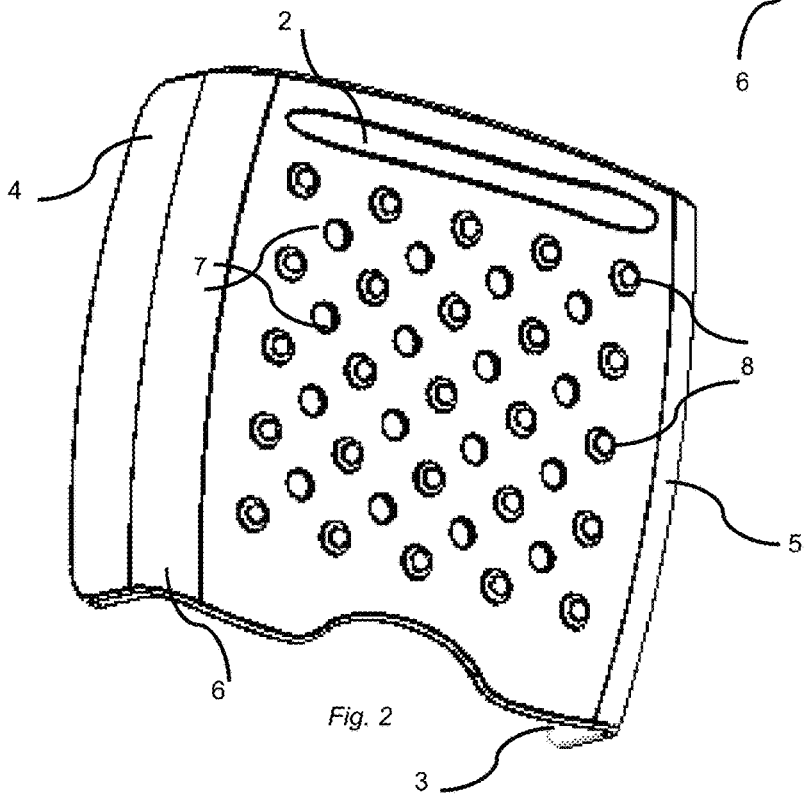
Figure 10:
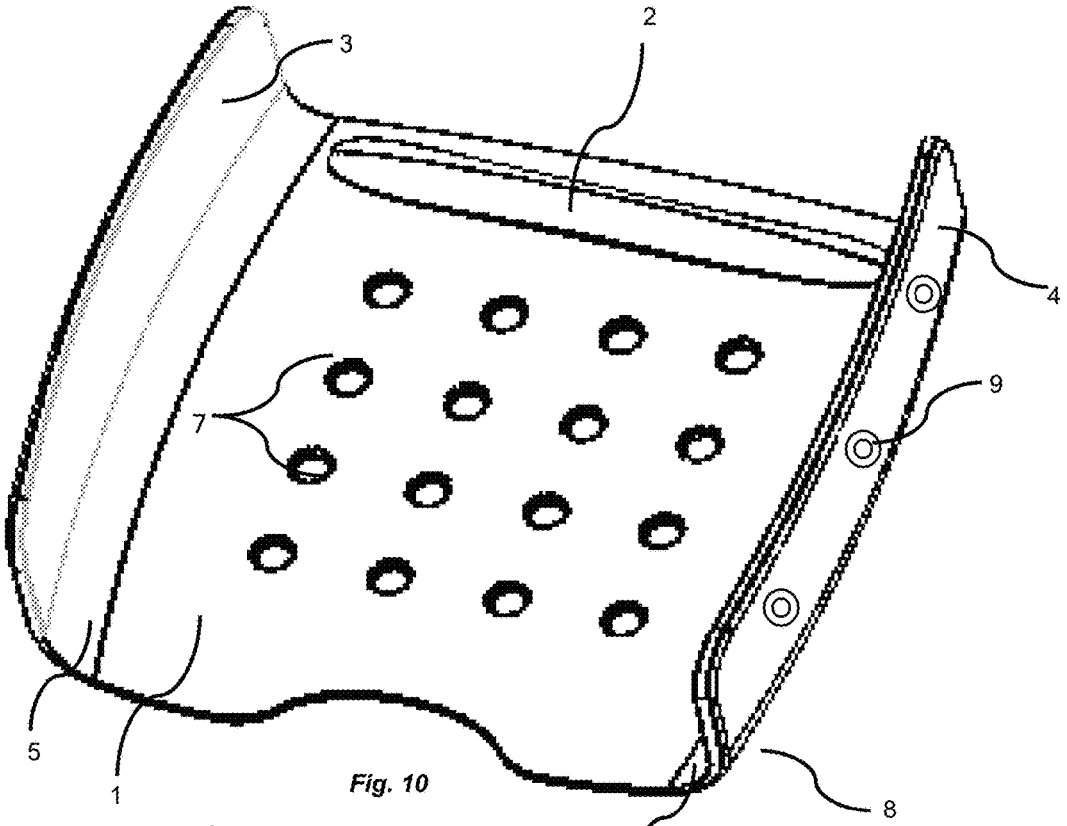
FIG. 10 is a zoomed-in top perspective view of the present invention in an alternate embodiment having attachment buttons on the wings.

Referring in particular to FIG. 1 and FIG. 2 wherein the invention herein referred to as foot and toe protection device (100) comprising of several parts: a. the bottom comfort pad (1), b. the toes support pad (2), c. the left and right wings (3) and (4), d. the left and right wing curves (5) and (6), e. the bottom breathing holes (7), f. the bottom non-skid bumps (8), and g. the left and right wing buttons (9), as shown in FIG. 10.

Wherein, the foot and toe protection device (100) is made of strong and comfortable material that stretches to comfortably fit and embrace the foot.

Wherein, the foot and toe protection device (100) is made of soft and flexible material to offer additional comfort when the material is in contact with the skin.

Wherein, the bottom comfort pad (1) offers comfort for the metatarsal region of the foot and offers additional support and reinforcement for the side connections with the left and right wings (3) and (4).

Wherein, the toes support pad (2) offers additional support and comfort to the three middle toes.

Wherein, the toes support pad (2) is made of a flexible cushion material for additional support and comfort during standing, walking, and supporting free movement of the toes.

Wherein, the left and right wings (3) and (4) extend upwards from the top portion of the bottom comfort pad (1).

Wherein, the left and right wings (3) and (4) are made of strong and comfortable material that curves to comfortably fit and embrace the sides of the foot.

Those skilled in the art will recognize that the left and right wings (3) and (4) could be formed in various shapes so as to create a securing brace having various sizes and shapes and still achieve the desired functionality as described herein.

Wherein, the left and right wings (3) and (4) provide support to allow the toes to better align in open or closed toe shoes and are the reinforcing mechanisms that prevent the pinky toes from bulging and protruding from the side of the shoes or sandals.

Wherein, the left and right wings (3) and (4) may be very slightly visible when worn. To minimize the visibility, the left and right wings (3) and (4) are made of a transparent elastomeric gel-like material and also made in various hues to blend with the users' skin-tone.

Wherein, the left and right wings (3) and (4) are flexible allowing the user to adjust to the side of the foot at various angles to better align with the design and style of the shoes or sandals, and to minimize visibility when worn.

Wherein, the left and right wing curves (5) and (6) allow the left and right wings (3) and (4) to hold their upward angel.

Wherein, the bottom breathing holes (7) provide an airway to allow the feet to breath.

Wherein, the bottom non-skid bumps (8) are the reinforcing mechanisms that prevent the feet from sliding and the toes from overhanging the front of the shoes or sandals.

Wherein, the bottom comfort pad (1), the toes support pad (2), the left and right wing curves (5) and (6), the bottom breathing holes (7), and the bottom non-skid bumps (8) are not visible when worn.

Wherein, the left and right wing buttons (9), as shown in FIG. 10, are the connection points for the alternate embodiment attachments.

Referring to FIG. 1, being formed of an elastomeric gel-like material allows the bottom comfort pad (1) to have properties such that stretching the bottom comfort pad (1) lengthwise causes the bottom comfort pad (1) to become thinner in diameter and thereby allowing for more easily alignment of the left and right wings (3) and (4) on the side of the user's foot. Upon release, a stretched bottom comfort pad (1) would contract in length and conform to the user's foot and effectively and snuggly hold the user's toes, thereby remaining in the desired position, after putting on shoes or sandals. In other words, when released, the bottom comfort pad (1) will provide a comfortable fit against the sides of the foot and thereby hold the invention in the desired position. Equally significant, the left and right wings (3) and (4) contract to impart a holding force on the sides of the toes as well, also holding the foot and toe protection device (100) in the desired position. The forces resulting from contraction and elongation, individually and in combination, easily enable a user to place, affix and maintain the foot and toe protection device (100) in position on the foot to snuggly hold the toes in place.

It should be noted that the description above with respect to the elastomeric gel-like material of the bottom comfort pad (1) is also applicable to the left and right wings (3) and (4). For example, the left and right wings (3) and (4) can also be formed of an elastomeric gel-like material that includes all of the flexible properties listed above. Thus, the left and right wings (3) and (4) is formed to also provide for extension and compression forces. In this aspect, the left and right wings (3) and (4) can be stretched to allow a user to position the left and right wings (3) and (4) against the sides of the user's foot in the desired position for maximum comfort and coverage for the side of the toes on both sides of the foot. Upon release of the stretched left and right wings (3) and (4), the left and right wings (3) and (4) contract in an attempt to return to its original shape which causes the left and right wings (3) and (4) to maximize the distribution of comfort to the sides of the foot.

Shown in FIG. 2, wherein the bottom non-skid bumps (8) is made of soft and flexible material to offer additional comfort between the bottom comfort pad (1) and the shoes or sandals.

Wherein, the bottom non-skid bumps (8) is made of a material to minimize any friction between the bottom non-skid bumps (8) and the shoes or sandals.

Wherein, the bottom non-skid bumps (8) may be made of a number of different materials that provide traction to prohibit the foot from sliding in the footwear.

Wherein, the bottom non-skid bumps (8) prevents a user's foot from sliding frontward preventing the toes from extending over the front edge of the footwear while remaining thin enough to be hidden under the foot when worn with shoes or sandals.

Figure 3:
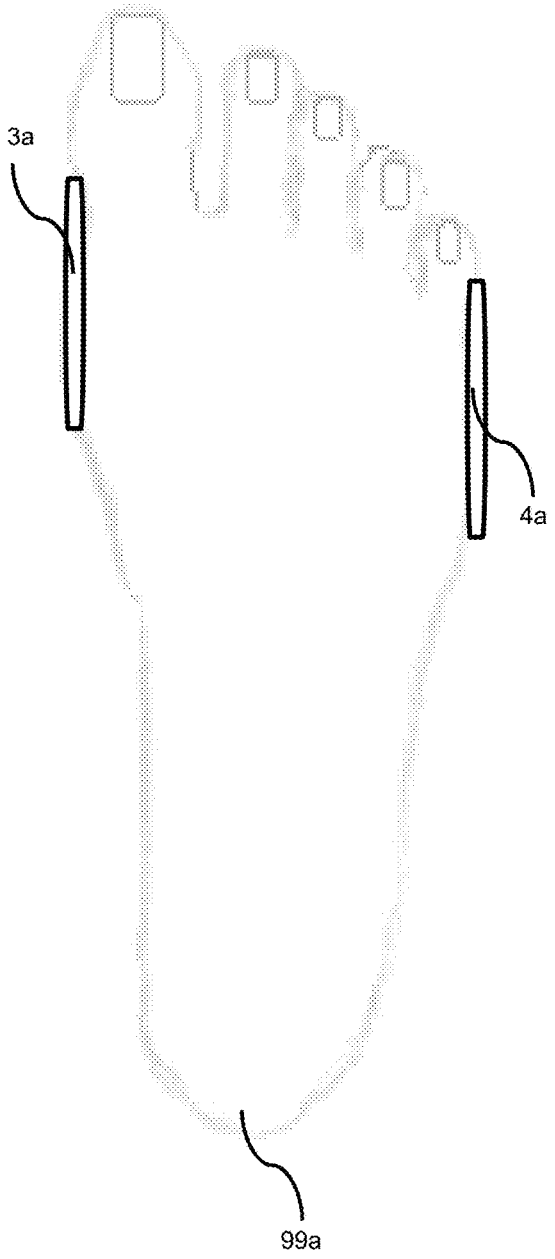
FIG. 3 and FIG. 4 is a perspective view of the present invention in use from the top and bottom of the right foot, respectively.

FIG. 3 is a perspective view of the present foot and toe protection device (100) in use from the top of the right foot (99*a*).

In FIG. 3, wherein, the left and right wings (3*a*) and (4*a*) may be slightly visible when worn. To minimize the visibility, the left and right wings (3*a*) and (4*a*) are made of a transparent elastomeric gel-like material and also made in various hues to blend with the users' skin-tone.

Wherein, the left and right wings (3*a*) and (4*a*) are shown in use on the top of the right foot (99*a*) after haven stretched the foot and toe protection device (100) lengthwise to fit the width of the foot.

Figure 4:
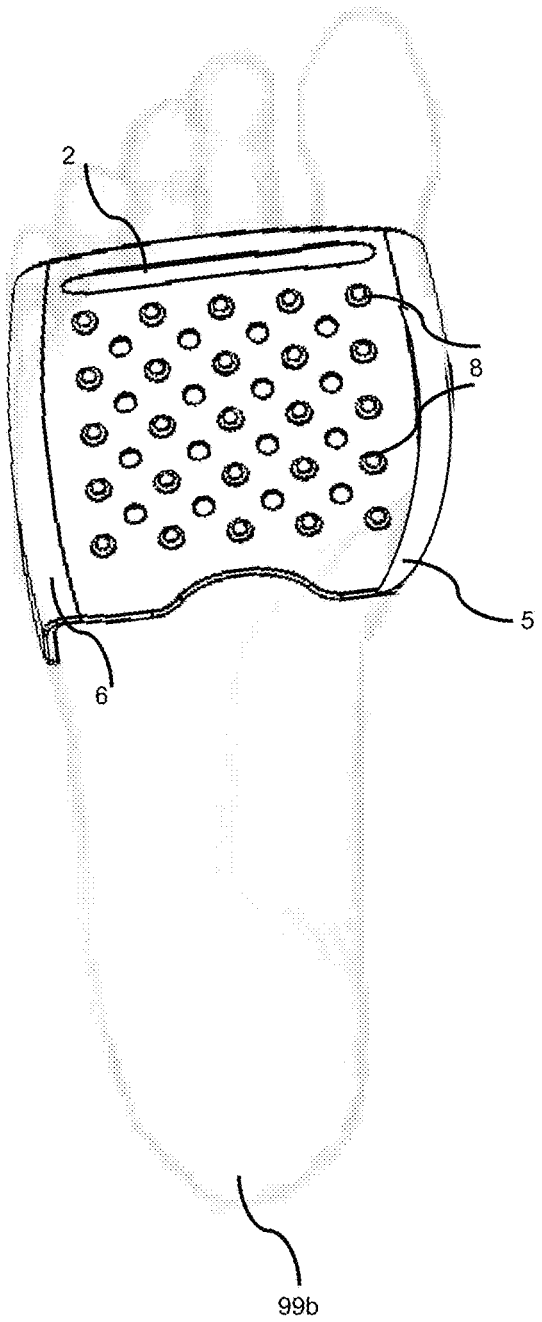

FIG. 4 is a perspective view of the foot and toe protection device (100) in use from the bottom of the right foot (99*b*).

In FIG. 4, wearing the foot and toe protection device (100) simply requires stretching lengthwise and adjusting the left and right wings (3) and (4) on the side of the foot. Stretch and adjust the bottom comfort pad (1), shown in FIG. 1, to fit comfortably on the metatarsal region of the foot.

Also shown in FIG. 1, the toes support pad (2) should instantly adjust comfortably under the three middle toes.

Figure 5:
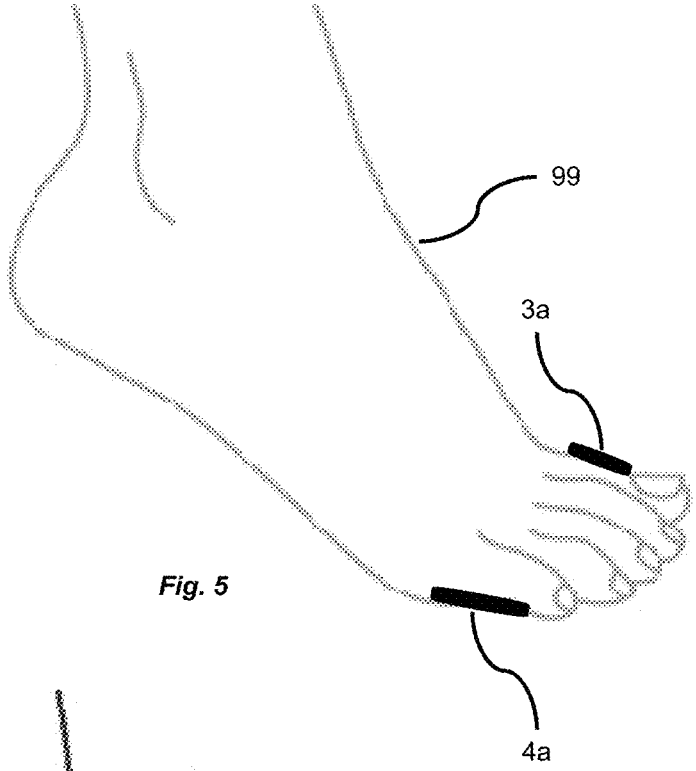
FIG. 5 is a perspective side view of the present invention in use on the right foot.

FIG. 5 is a perspective side view of the foot and toe protection device (100) in use from the right side of the right foot (99).

Figure 6:
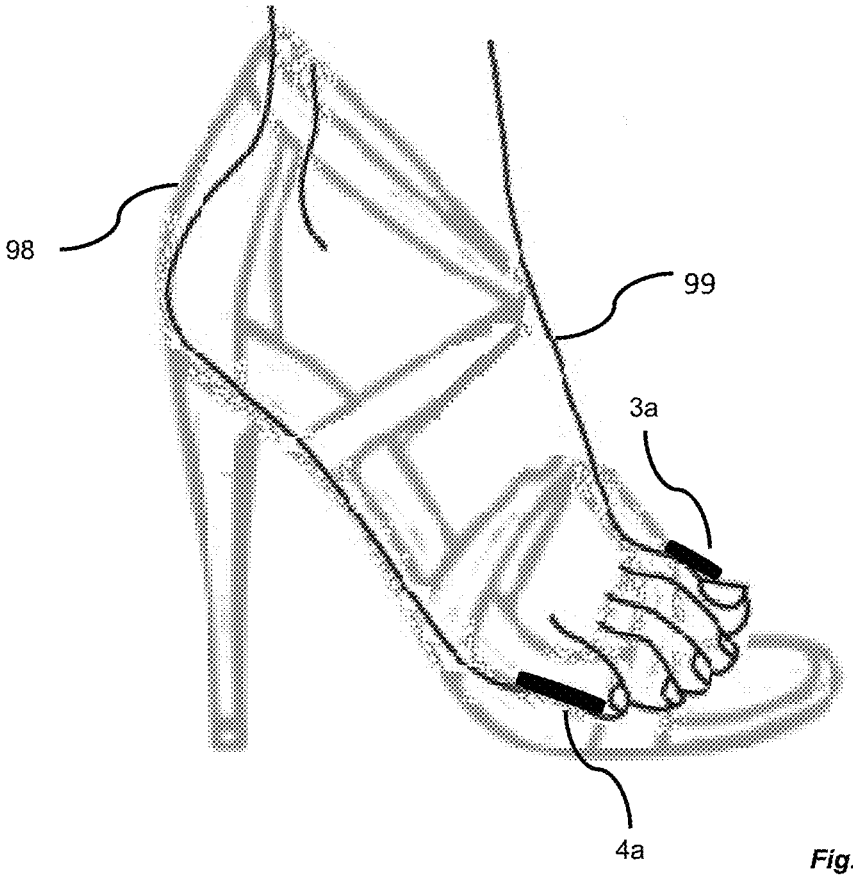
FIG. 6 is a perspective side view of the present invention in use on the right foot inserted into an open toe sandal.

In FIG. 5 and FIG. 6, the left and right wings (3*a*) and (4*a*) are shown in black for emphasis in the drawing.

FIG. 6 is a perspective side view of the foot and toe protection device (100) in use from the right side of the right foot (99) inserted into a sandal (98).

Shown in FIG. 5 and FIG. 6, the rounded and elongated form of the left and right wings (3*a*) and (4*a*) further provide the ability to be camouflaged by a portion of the shoes and sandals so as to minimize the effect on the cosmetic appearance of the foot and toe protection device (100). Additionally, the left and right wings (3*a*) and (4*a*) is made of a transparent elastomeric gel-like material and also made in various hues to blend with the users' skin-tone.

With the structure above described, it will at once be apparent that the foot and toe protection device (100) is extremely resilient, flexible, stretchable, and may be made sufficiently thin and light in weight as to be substantially unnoticeable to the user while being worn with open toe style shoes or sandals.

While no particular measurements for the foot and toe protection device (100) are required, better results will be achieved utilizing the said device at the following preferred approximate measures: a. the left and right side toe support braces at approximately 1½"-2" in width and 1"-2" in width, respectively, b. the left and right side toe support braces at approximately 1" in height on the left and right sides extended upward from the bottom comfort pad, c. the left and right side toe support braces at approximately ⅛"-¼" in thickness, wherein, the thickness is adjustable in size to accommodate the enclosed inner layers, d. the bottom comfort pad at approximately 2"-3" in width, e. the bottom comfort pad at approximately 3"-4" in length, f. the toes support pad at approximately ¼" in width, g. the toes support pad at approximately 2" in length.

While the foregoing written description of the foot and toe protection device (100) enables one of ordinary skill to make and use what is considered presently to be the best mode thereof, those of ordinary skill will understand and appreciate the existence of variations, combinations, and equivalents of the specific embodiment, method, and examples herein. The foot and toe protection device (100) should therefore not be limited by the above described embodiment, method, and examples, but by all embodiments and methods within the scope and spirit of the foot and toe protection device (100) as claimed.

Description of Additional Embodiments

The objective of the present invention in this alternate embodiment is to provide a smaller adaptive size to be worn with shoe or sandal styles with narrow straps to further minimize the left and right wings (3) and (4) visibility and a securing top strap.

The alternate embodiment shown in FIG. 7 and FIG. 8 shows a zoomed-in perspective view of the invention with a smaller bottom comfort pad (1), smaller left and right wings (3) and (4), and a securing strap (10). This embodiment will herewith be referred to as foot and toe protection device strap (200).

The descriptions previously stated for FIG. 1 and FIG. 2 will not be restated in describing FIG. 7 and FIG. 8. The descriptions stated for FIG. 7 and FIG. 8 will describe the alternate embodiment parts of the invention for the foot and toe protection device strap (200) as an extension of foot and toe protection device (100).

Referring in particular to FIG. 7 and FIG. 8 herein the foot and toe protection device strap (200) comprising of several parts: a. the smaller and modified bottom comfort pad (1), b. the smaller and modified left and right wings (3) and (4), c. the left and right wing curves (5) and (6), d. the bottom breathing holes (7), e. the bottom non-skid bumps (8), and f. the securing strap (10).

In FIG. 7, wherein, the smaller and modified left and right wings (3) and (4) extend upwards from the top portion of the bottom comfort pad (1) to comfortably fit and embrace the sides of the toes.

Also shown in FIG. 7, wherein, the securing strap (10) stretches across the top of the wearer's foot connecting to the left and right wings (3) and (4) of the foot and toe protection device strap (200).

Wherein the securing strap (10) adds an additional aesthetic, fashionable, and stylish appeal to the foot and toe protection device strap (200).

Wherein, the securing strap (10) consists of various fashionable and stylish designs, patterns and colors, images, beads or jewels, and various hues to blend with the user's skin-tone, to enhance the appeal and allow the user to coordinate with their attire.

Figure 9:
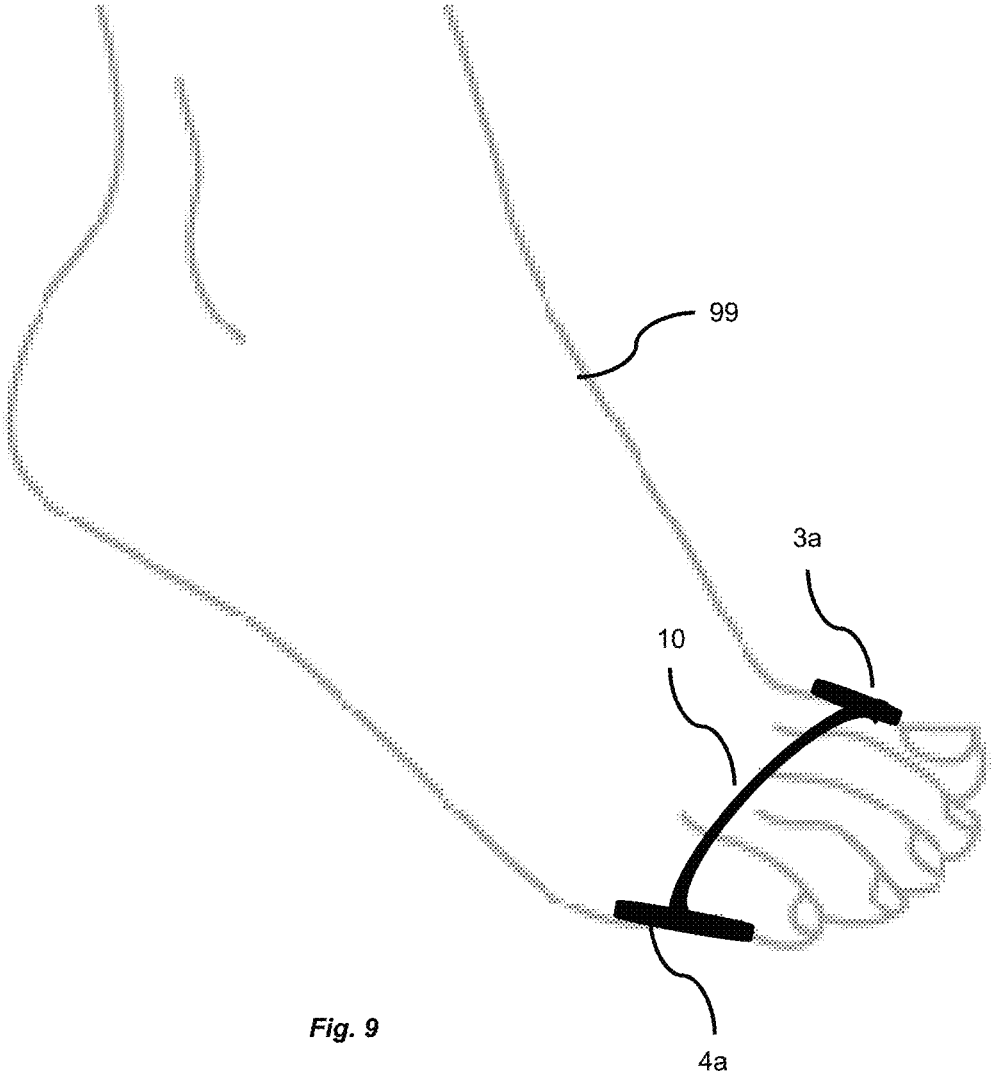
FIG. 9 is a perspective side view of the present invention in an alternate embodiment having a strap across the top of the foot in use on the right foot; and FIG. 10

FIG. 9 is a perspective side view of the foot and toe protection device strap (200) in use from the right side of the right foot (99).

In FIG. 9, the left and right wings (3*a*) and (4*a*) and the securing strap (10) are shown in black for emphasis in the drawing.

Shown in FIG. 9, the smaller and modified form of the left and right wings (3*a*) and (4*a*) further provide the ability to be camouflaged by a portion of the shoes and sandals so as to minimize the effect on the cosmetic appearance of the foot and toe protection device strap (200). Additionally, the left and right wings (3*a*) and (4*a*) is made of a transparent elastomeric gel-like material and also made in various hues to blend with the users' skin-tone.

In FIG. 9, wearing the foot and toe protection device strap (200) simply requires stretching lengthwise and adjusting the smaller and modified left and right wings (3) and (4) on the side of the foot. Stretch and adjust the smaller and modified bottom comfort pad (1), shown in FIG. 7, to fit comfortably on the metatarsal region of the foot. Also shown in FIG. 9, the securing strap (10) should fit comfortably over the top of the foot and be adjusted to minimize visibility for the shoe or sandal style.

The objective of the present invention in this alternate embodiment is to provide a customized foot and toe protection device (100) to be worn with various shoe or sandal styles by attaching other alternate embodiments.

Figure 11:
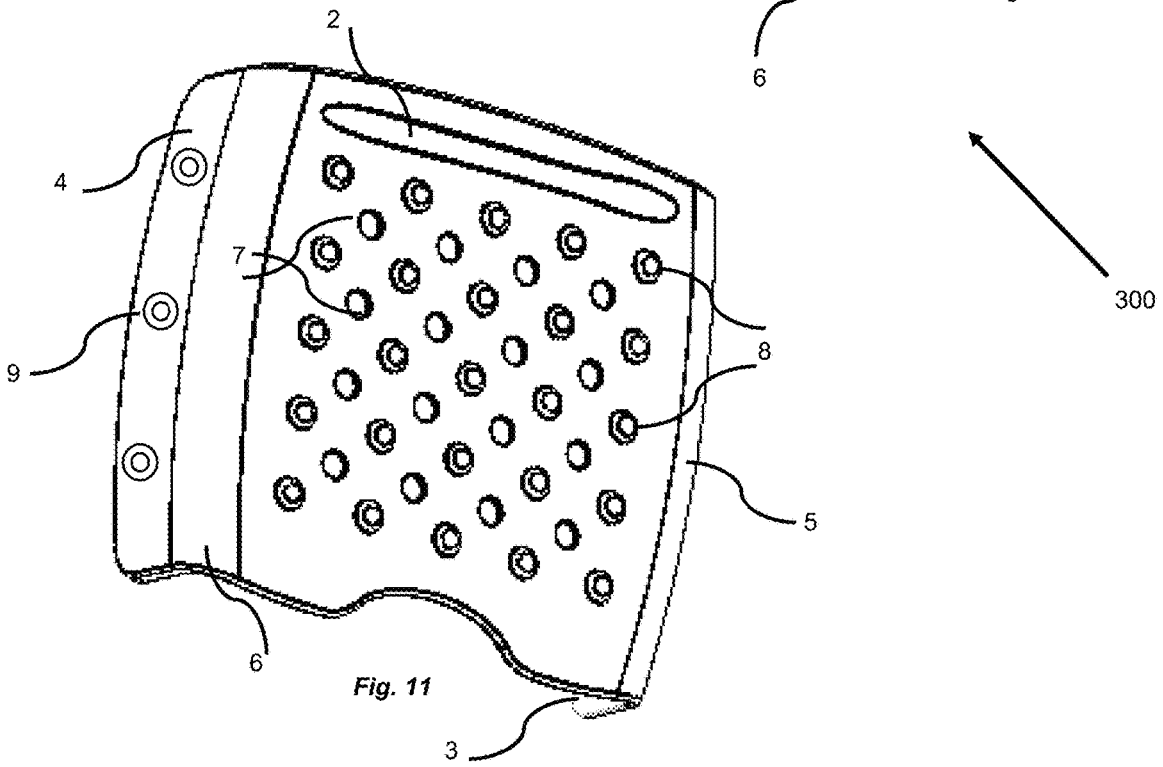
FIG. 11 is a zoomed-in perspective view of the present invention in an alternate embodiment having attachment buttons on the wings.

The alternate embodiment shown in FIG. 10 and FIG. 11 shows a zoomed-in perspective view of the invention with the left and right wing buttons (9). This embodiment will herewith be referred to as foot and toe protection device extended (300).

The descriptions previously stated for FIG. 1 and FIG. 2 will not be restated in describing FIG. 10 and FIG. 11. The descriptions stated for FIG. 10 and FIG. 11 will describe the alternate embodiment parts of the invention for the foot and toe protection device extended (300) as an extension of foot and toe protection device (100).

Referring in particular to FIG. 10 and FIG. 11 herein the foot and toe protection device extended (300) comprising of several parts: a. the bottom comfort pad (1), b. the toes support pad (2), c. the left and right wings (3) and (4), d. the left and right wing curves (5) and (6), e. the bottom breathing holes (7), f. the bottom non-skid bumps (8), and g. the left and right wing buttons (9).

In FIG. 10, wherein, the left and right wing buttons (9) extend outwards from the left and right wings (3) and (4) to provide the anchor to attach other alternate embodiments.

The objective of the present invention in this alternate embodiment is to provide a customized attachments to be worn with the foot and toe protection device extended (300) to be attached to the left and right wing buttons (9).

Figure 12:
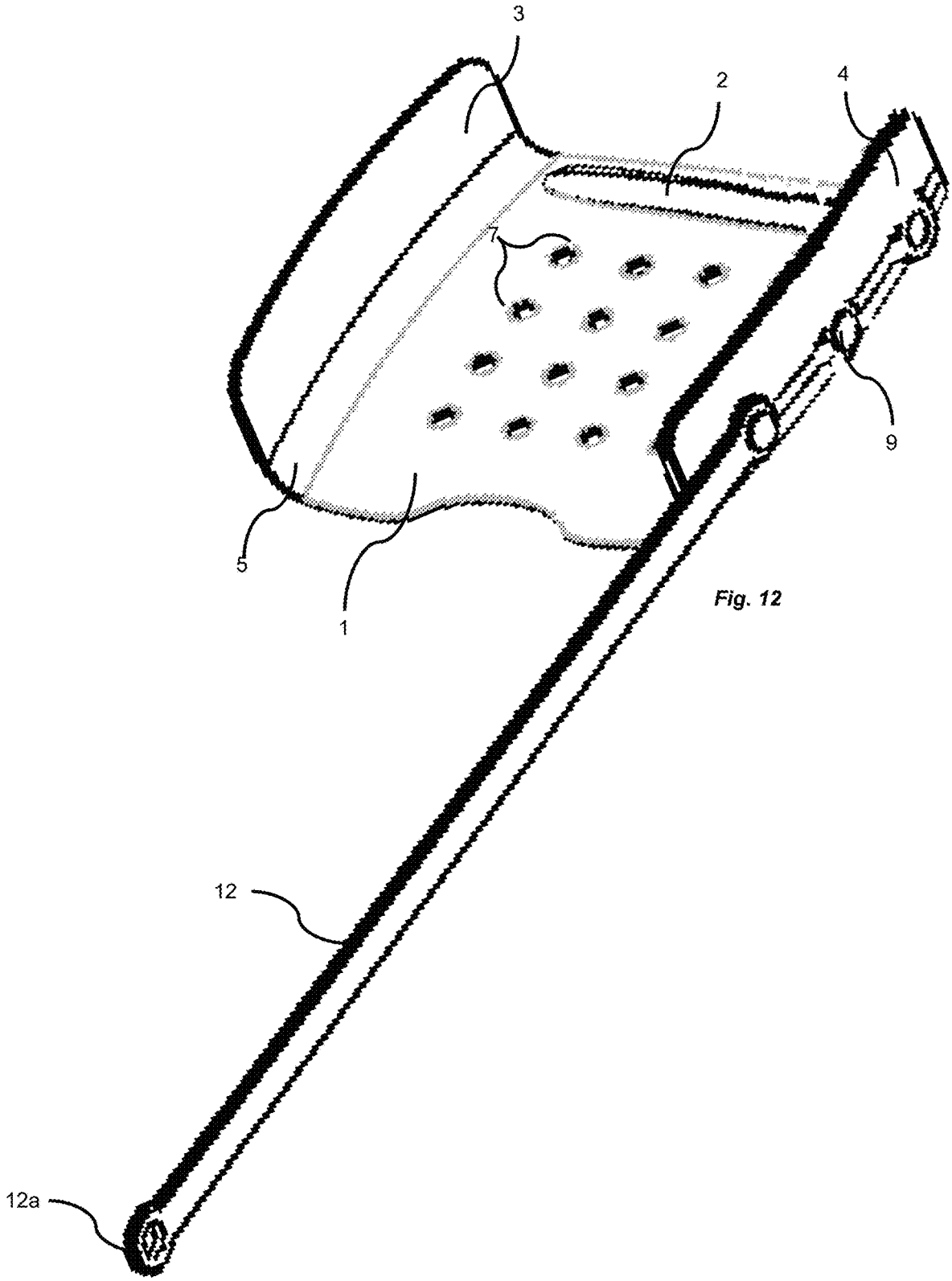
FIG. 12 is a zoomed-in top perspective view of the present invention in an alternate embodiment having a heel strap attached to the button on the side of the wing.

The alternate embodiment shown in FIG. 12 shows a zoomed-in perspective view of the invention with the heel strap (12) attached to the foot and toe protection device extended (300).

Referring in particular to FIG. 10 herein the heel strap (12) comprising of several parts: a. the heel strap (12), and b. the heel strap hole (12*a*).

In FIG. 12, wherein, the heel strap hole (12*a*) is shown in use attached to a right wing button of the left and right wing buttons (9) of the foot and toe protection device extended (300).

Figure 13:
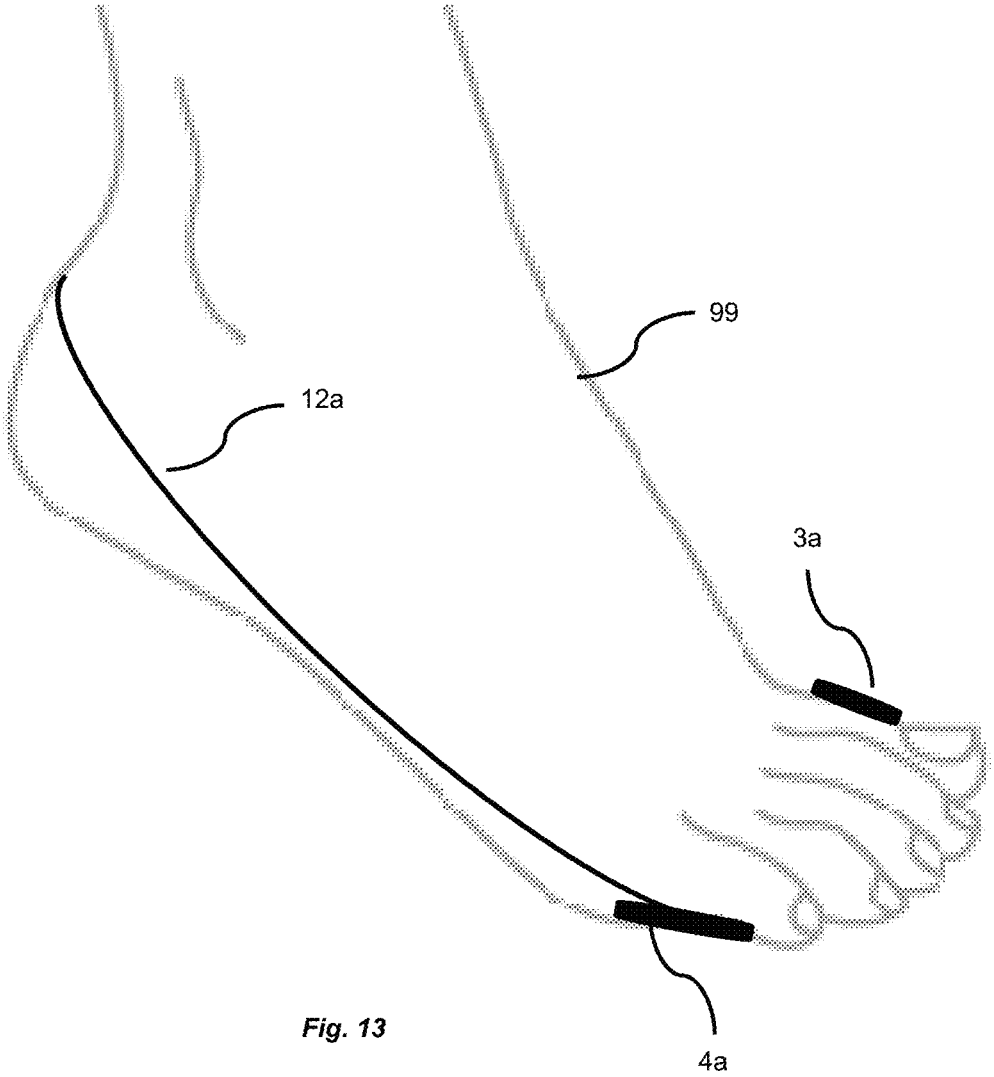
FIG. 13 is a perspective side view of the present invention in an alternate embodiment having a heel strap attached to the buttons on the side of the wing in use on the right foot.

FIG. 13 is a perspective side view of the heel strap (12) in use from the right side of the right foot (99).

In FIG. 13, wherein the heel strap (12) adds an additional aesthetic, fashionable, and stylish appeal to the foot and toe protection device extended (300).

In FIG. 13, the heel strap (12) and the foot and toe protection device extended (300) are shown in black for emphasis in the drawing.

Wearing the heel strap (12) simply requires stretching the foot and toe protection device extended (300) lengthwise and adjusting the left and right wings (3) and (4) on the side of the foot. Stretch and adjust the bottom comfort pad (1), shown in FIG. 12, to fit comfortably on the metatarsal region of the foot. The toes support pad (2) should instantly adjust comfortably under the three middle toes. As shown in FIG. 13, the heel strap hole (12*a*) should be attached to a right wing button of the left and right wing buttons (9), the heel strap (12) should then be stretched from the right side around the back of the heel to the left side to attach the other heel strap hole (12*a*) to a left wing button of the left and right wing buttons (9).

Adjust the foot and toe protection device extended (300) and the heel strap (12) to minimize visibility for the shoe or sandal style.

The objective of the present invention in this alternate embodiment is to provide another customized attachments to be worn with the foot and toe protection device extended (300) to be attached to the left and right wing buttons (9).

Figure 14:
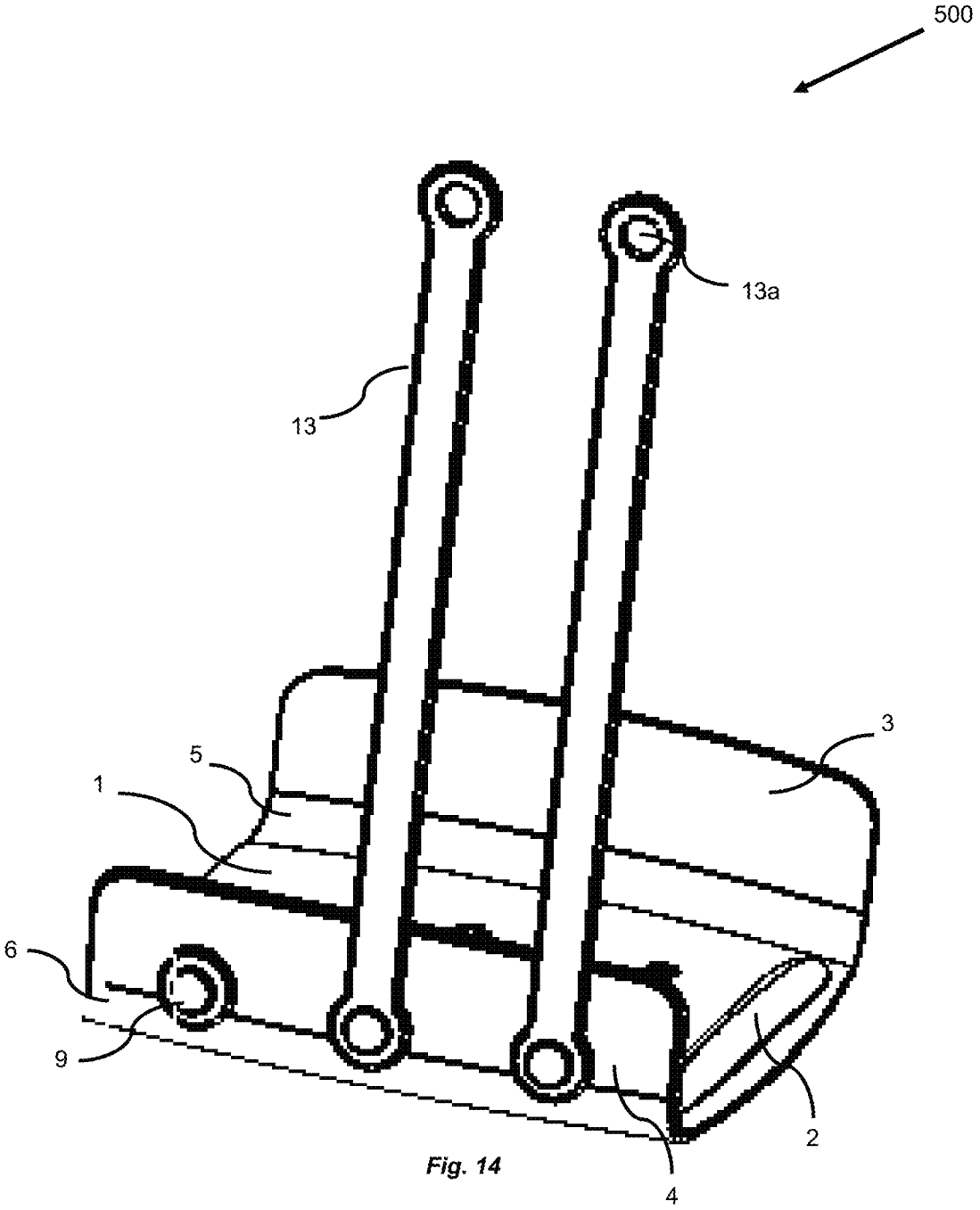
FIG. 14 is a zoomed-in top perspective view of the present invention in an alternate embodiment having dual straps attached to the buttons on the side of the wing.

The alternate embodiment shown in FIG. 14 shows a zoomed-in perspective view of the invention with the dual straps (13) attached to the foot and toe protection device extended (300).

Referring in particular to FIG. 14 herein the dual straps (13) comprising of several parts: a. the dual straps (13), and b. the dual straps hole (13*a*).

In FIG. 14, wherein, the dual straps hole (13*a*) is shown in use attached to the right wing buttons of the left and right wing buttons (9) of the foot and toe protection device extended (300).

Figure 15:
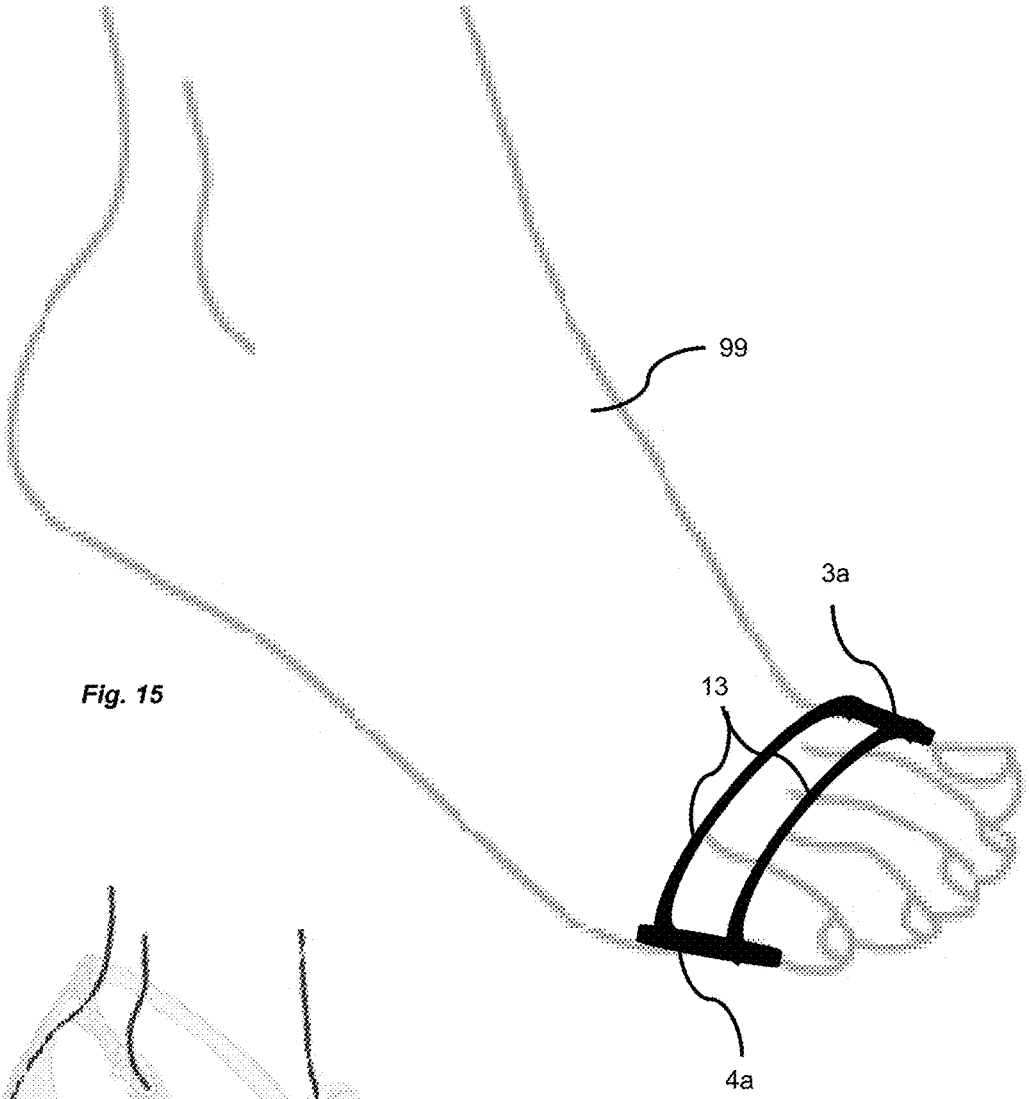
FIG. 15 is a perspective side view of the present invention in an alternate embodiment having dual straps attached to the buttons on the side of the wing in use on the right foot.

FIG. 15 is a perspective side view of the dual straps (13) in use from the right side of the right foot (99).

In FIG. 15, wherein the dual straps (13) extended across the top of the wearer's foot in a side-by-side parallel fashion add an additional aesthetic, fashionable, and stylish appeal to the foot and toe protection device extended (300).

Figure 16:
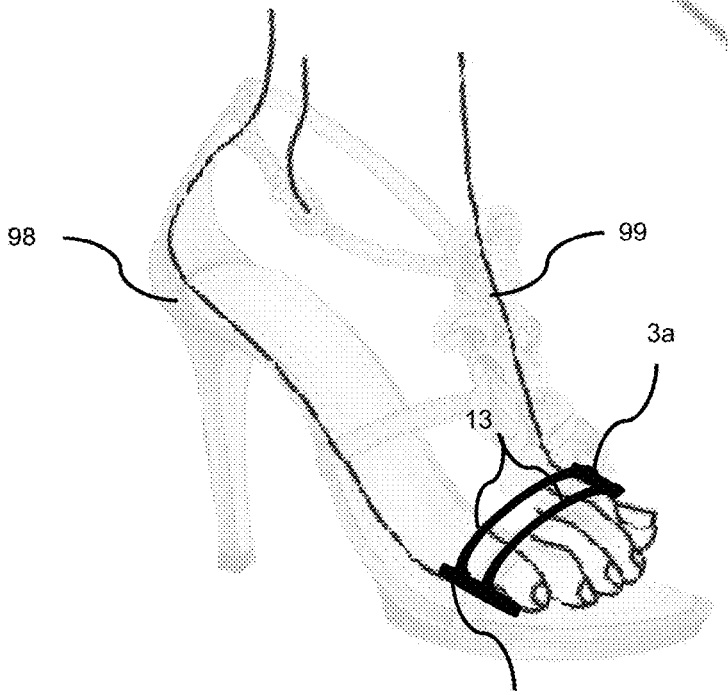
FIG. 16 is a perspective side view of the present invention in an alternate embodiment having dual straps attached to the buttons on the side of the wing in use on the right foot inserted into an open toe sandal.

FIG. 16 is a perspective side view of the foot and toe protection device extended (300) and the dual straps (13) in use from the right side of the right foot (99) inserted into a sandal (98).

Figure 17:
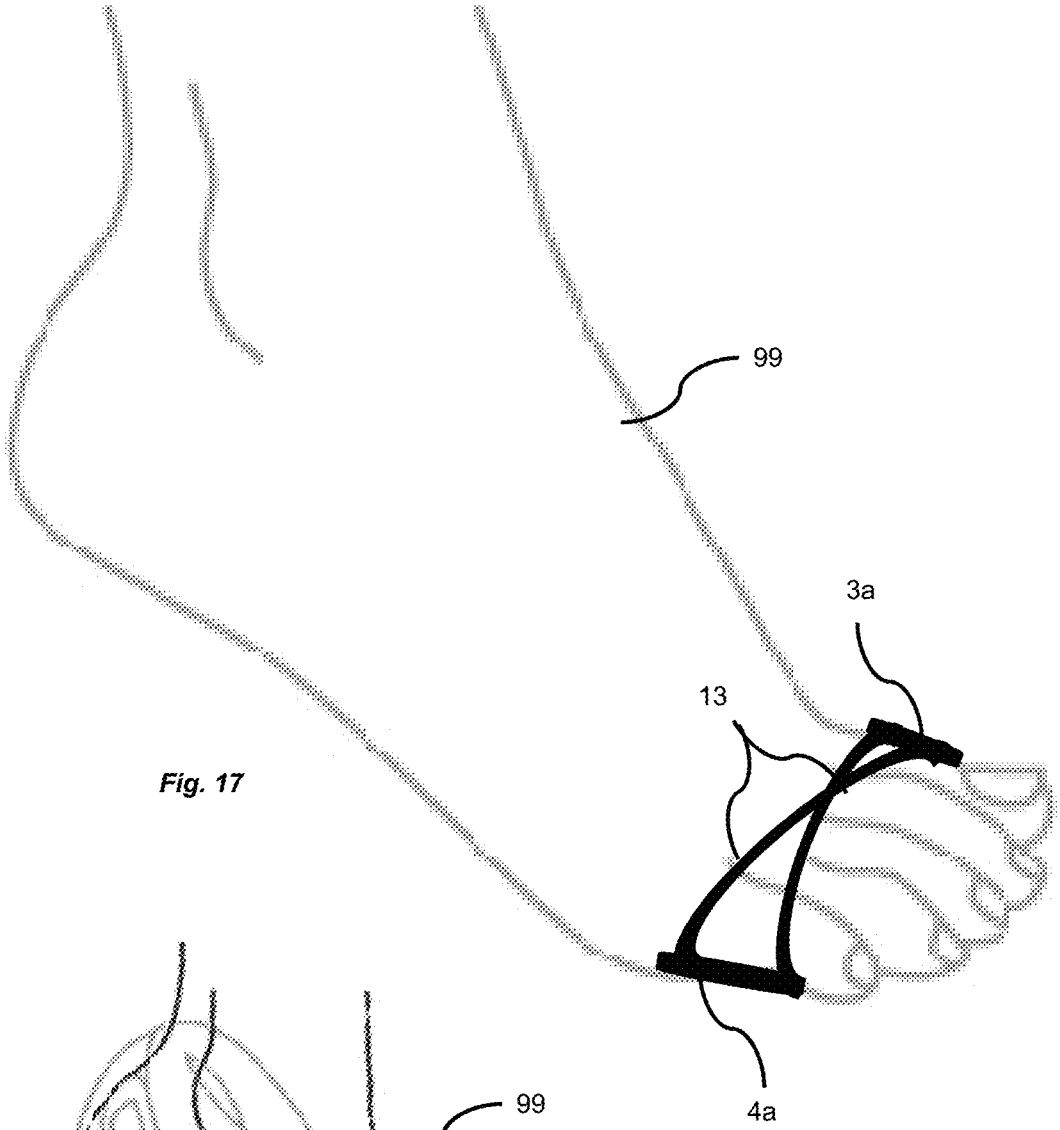
FIG. 17 is a perspective side view of the present invention in an alternate embodiment having diagonally crossed dual straps attached to the buttons on the side of the wing in use on the right foot.

FIG. 17 is a perspective side view of the dual straps (13) in use from the right side of the right foot (99).

In FIG. 17, wherein the dual straps (13) extended across the top of the wearer's foot in a diagonal crisscross fashion add an additional aesthetic, fashionable, and stylish appeal to the foot and toe protection device extended (300).

Figure 18:
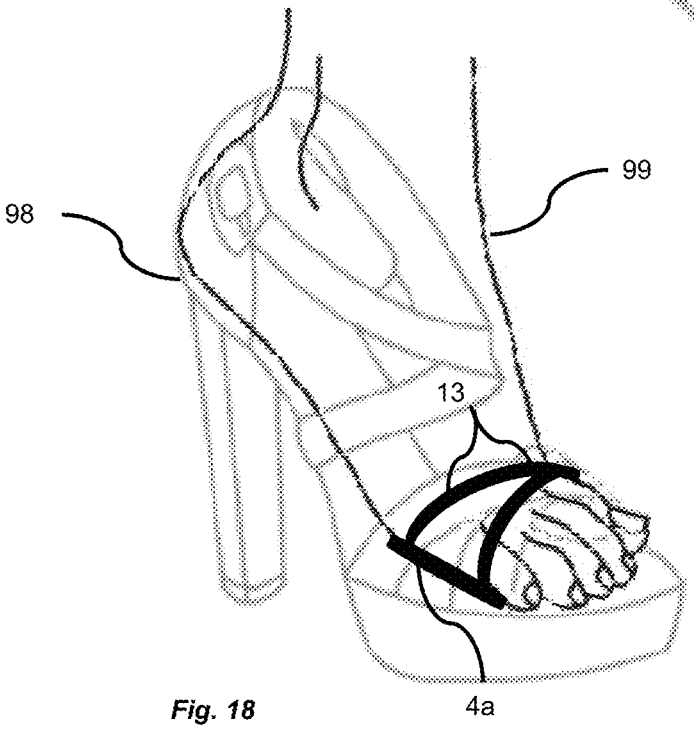
FIG. 18 is a perspective side view of the present invention in an alternate embodiment having diagonally crossed dual straps attached to the buttons on the side of the wing in use on the right foot inserted into an open toe sandal.

FIG. 18 is a perspective side view of the foot and toe protection device extended (300) and the dual straps (13) in use from the right side of the right foot (99) inserted into a sandal (98).

In FIG. 15, FIG. 16, FIG. 17, and FIG. 18, the dual straps (13) and the foot and toe protection device extended (300) are shown in black for emphasis in the drawing.

Wearing the dual straps (12) simply requires stretching the foot and toe protection device extended (300) lengthwise and adjusting the left and right wings (3) and (4) on the side of the foot. Stretch and adjust the bottom comfort pad (1), shown in FIG. 12, to fit comfortably on the metatarsal region of the foot. The toes support pad (2) should instantly adjust comfortably under the three middle toes. As shown in FIG. 14, the dual straps hole (13*a*) should be attached to the right wing buttons of the left and right wing buttons (9), the dual straps (12) should then be stretched from the right side across the top of the foot to the left side to attach the other dual straps hole (13*a*) to the left wing buttons of the left and right wing buttons (9).

Adjust the foot and toe protection device extended (300) and the dual straps (12) to minimize visibility for the shoe or sandal style.

The objective of the present invention in this alternate embodiment is to provide another customized attachments to be worn with the foot and toe protection device extended (300) to be attached to the left and right wing buttons (9).

Figure 19:
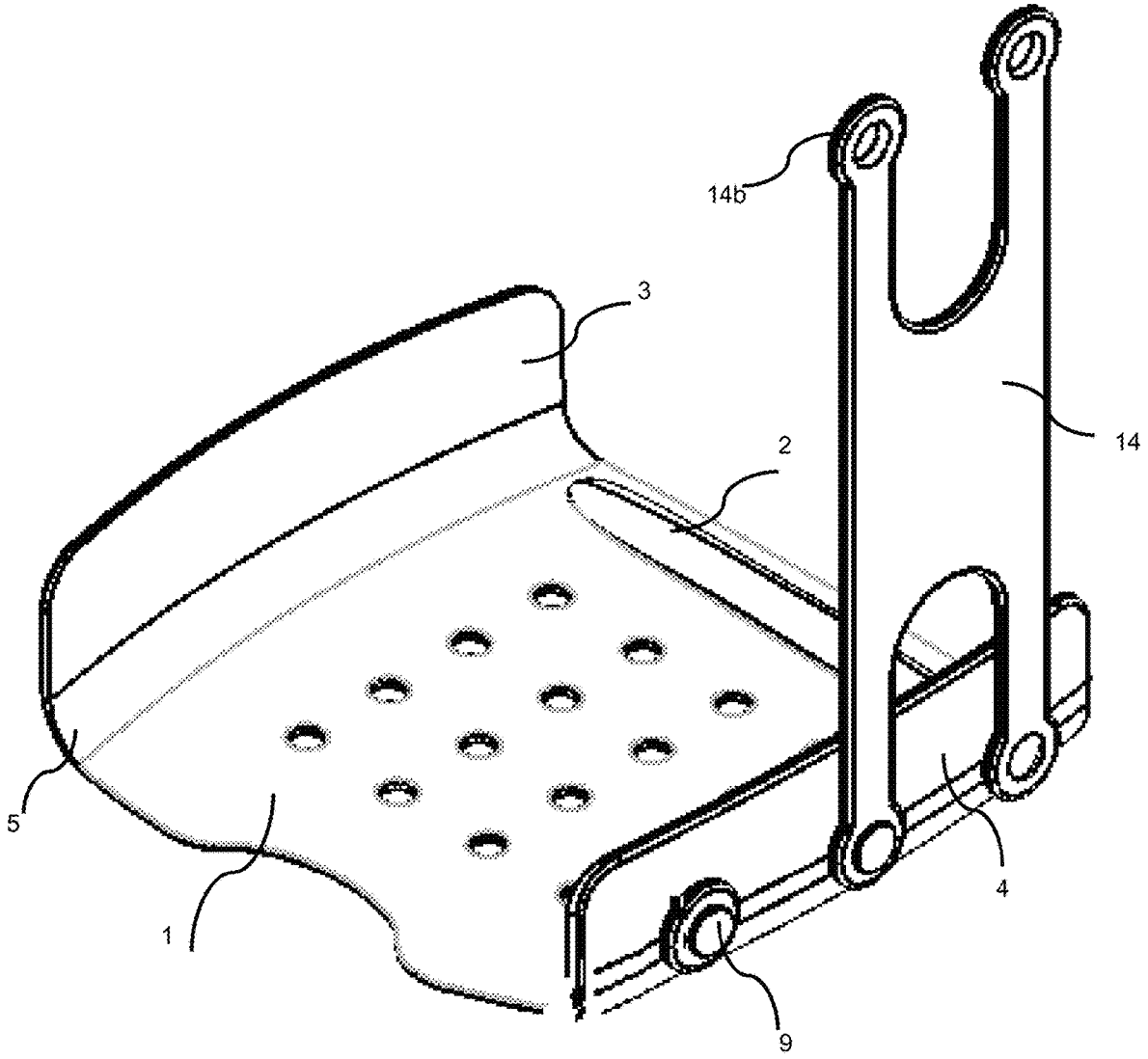
FIG. 19 is a zoomed-in top perspective view of the present invention in an alternate embodiment having a wide band strap attached to the buttons on the side of the wing.

The alternate embodiment shown in FIG. 19 shows a zoomed-in perspective view of the invention with the dual straps band (14) attached to the foot and toe protection device extended (300).

Referring in particular to FIG. 19 herein the dual straps band (14) comprising of several parts: a. the dual straps band (14), and b. the dual straps band hole (14*a*).

In FIG. 19, wherein, the dual straps band hole (14*a*) is shown in use attached to the right wing buttons of the left and right wing buttons (9) of the foot and toe protection device extended (300).

FIG. 20 is a perspective side view of the dual straps band (14) in use from the right side of the right foot (99).

In FIG. 20, wherein the dual straps band (14) extends across the top of the wearer's foot for an additional aesthetic, fashionable, and stylish appeal to the foot and toe protection device extended (300).

FIG. 21 is a perspective side view of the foot and toe protection device extended (300) and the dual straps band (14) in use from the right side of the right foot (99) inserted into a sandal (98).

In FIG. 20 and FIG. 21, the dual straps band (14) and the foot and toe protection device extended (300) are shown in black for emphasis in the drawing.

Wearing the dual straps band (14) simply requires stretching the foot and toe protection device extended (300) lengthwise and adjusting the left and right wings (3) and (4) on the side of the foot. Stretch and adjust the bottom comfort pad (1), shown in FIG. 12, to fit comfortably on the metatarsal region of the foot. The toes support pad (2) should instantly adjust comfortably under the three middle toes. As shown in FIG. 19, the dual straps band hole (14*a*) should be attached to the right wing buttons of the left and right wing buttons (9), the dual straps band (14) should then be stretched from the right side across the top of the foot to the left side to attach the other dual straps band hole (14*a*) to the left wing buttons of the left and right wing buttons (9).

Adjust the foot and toe protection device extended (300) and the dual straps band (14) to minimize visibility for the shoe or sandal style.

Figure 22:
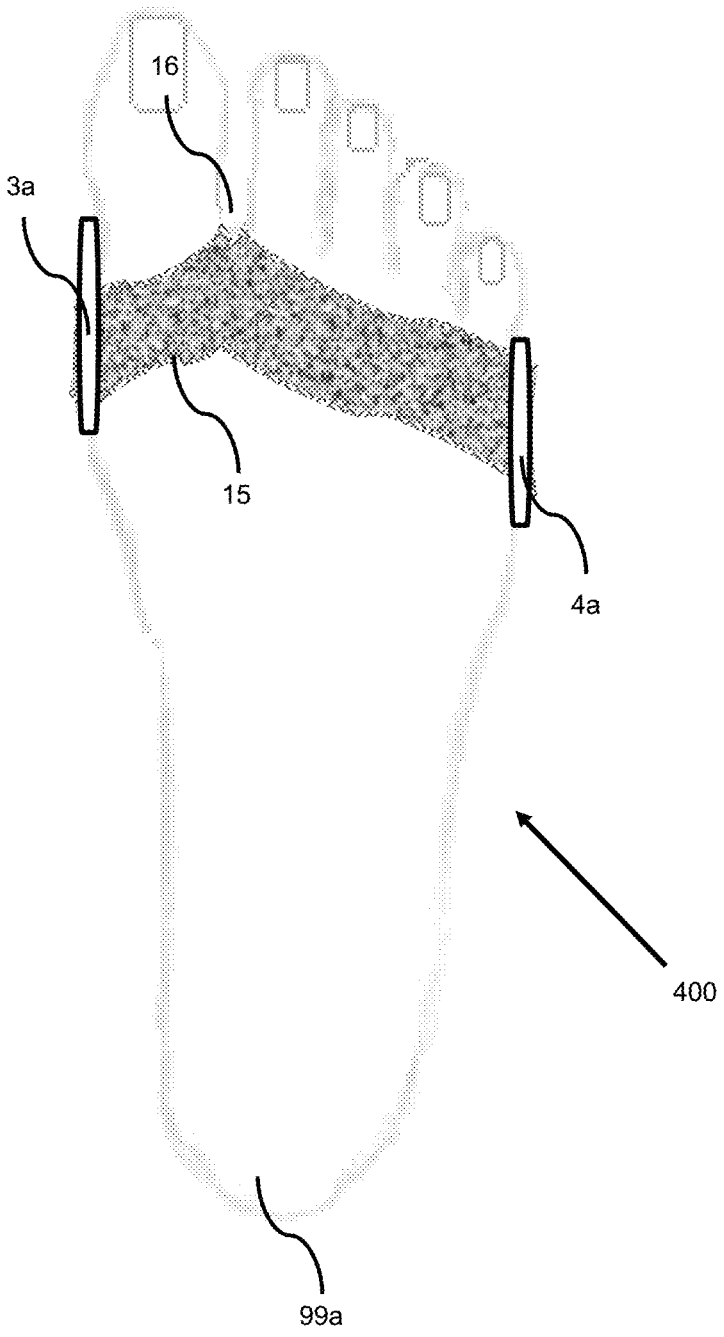
FIG. 22 is a zoomed-in top perspective view of the present invention in an alternate embodiment having a decorative front made of lace or other decorative material; and having a thong part between the big toe and the second toe.

Another alternate embodiment shown in FIG. 22 shows a zoomed-in top perspective view of the foot and toe protection device strap (200) with a decorative front for wearing with thong type shoes and sandals. This embodiment will herewith be referred to as foot and toe protection device thong (400).

FIG. 22 is a perspective view of the foot and toe protection device thong (400) in use from the top of the right foot (99*a*).

The descriptions previously stated for FIG. 1 and FIG. 2 will not be restated in describing FIG. 22. The descriptions stated for FIG. 22 will describe the alternate embodiment parts of the invention for the foot and toe protection device thong (400) as an extension of foot and toe protection device strap (200).

Referring in particular to FIG. 22 herein the foot and toe protection device thong (400) comprising of several parts: a. the foot and toe protection device strap (200) as the base, b. the decorative front (15), and c. a protective thong strap (16).

The decorative front (15), the foot and toe protection device strap (200), and the thong strap (16) are all joined together forming one unit.

The decorative front (15) is joined on the top left and right sides of the foot and toe protection device strap (200).

The thong strap (16) joins together the decorative front (15) and the foot and toe protection device strap (200) forming a looped opening for the big toe and an opening for the other toes positioned separately.

The thong strap (16) joins together the decorative front (15) and the bottom of foot comfort pad (1) of the foot and toe protection device strap (200) shown in FIG. 22, between the big toe and the second toe.

Wherein, the foot and toe protection device thong (400) offers a thong strap (16) for ease to the webbed spacing between the toes when wearing thong type shoes or sandals.

The thong strap (16) is semi-circular to provide added comfort in the webbed space between the big toe and the second toe when wearing thong type shoes or sandals.

The thong strap (16) fits between the big toe and second toe to allow for a comfortable fit when wearing thong type shoe or sandal.

The thong strap (16) serves as a protective device against frictional irritation due to wearing thong-type sandals and other footwear.

Wherein the decorative front (15) adds an additional aesthetic, fashionable, and stylish appeal to the foot and toe protection device thong (400).

Wherein, the decorative front (15) may be made of a lace material and also can be made in various fashionable and stylish designs and materials, patterns and colors, images, beads or jewels, and various hues to blend with the user's skin-tone, to enhance the appeal and allow the user to coordinate with their attire.

Wherein, the decorative front (15) extends across the top of the wearer's foot connecting to the left and right wings (3*a*) and (4*a*) of the foot and toe protection device strap (200).

Wearing the foot and toe protection device thong (400) simply requires sliding the foot into the foot and toe protection device thong (400) and adjusting the left and right wings (3*a*) and (4*a*) of the foot and toe protection device strap (200) on each side of the foot. Adjust the thong strap (16) between the big toe and the second toe, adjust the decorative front (15), on the top of the foot such that the decorative front (15) substantially covers an area of the front portion and top portion of the foot (99).

The objective of the present invention in this alternate embodiment is to provide a sole adaptive size, can be expanded in accordance with the length and width of the forefoot region of the wearer's foot, and provide good wearing comfort.

Figure 23:
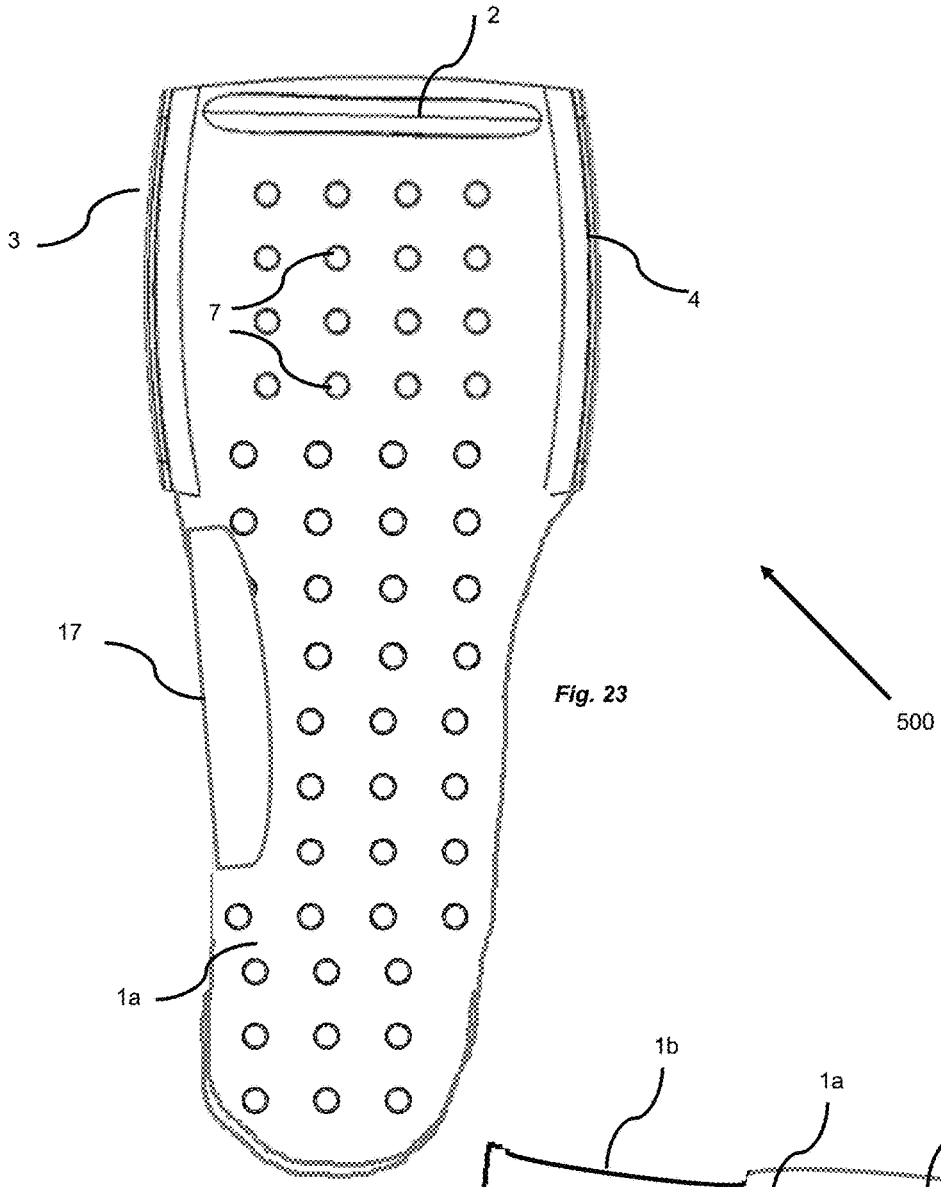
FIG. 23 is a zoomed-in top perspective view of the present invention in an alternate embodiment having a full length foot pad and an arch support.

An alternate embodiment shown in FIG. 23 shows a zoomed-in top perspective view of the foot and toe protection device (100) with an elongated full length bottom comfort pad. This embodiment will herewith be referred to as foot and toe protection device consoler (500).

Figure 24:
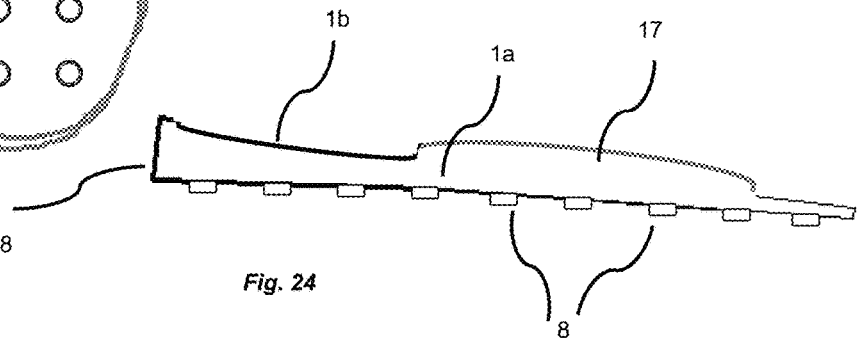
FIG. 24 is a zoomed-in side perspective view of the present invention in an alternate embodiment having a full length foot pad, an arch support, and a sunken heel cradle.

The descriptions previously stated for FIG. 1 and FIG. 2 will not be restated in describing FIG. 23 and FIG. 24. The descriptions stated for FIG. 23 and FIG. 24 will describe the alternate embodiment parts of the invention for the foot and toe protection device consoler (500) as an extension of foot and toe protection device (100).

Referring in particular to FIG. 23 herein the foot and toe protection device consoler (500) comprising of several parts: a. the foot and toe protection device (100) as the base, b. a full length bottom comfort pad (1*a*), c. an elevated arch support (17), and d. an elevated heel pad (18).

Wherein, the foot and toe protection device consoler (500) is made of the same transparent elastomeric gel-like materials as the foot and toe protection device (100).

The foot and toe protection device consoler (500) wherein the full length bottom comfort pad (1*a*) is made of soft and flexible material to offer additional support and comfort to the foot, arch, and heel of the foot during standing and walking.

Wherein, in FIG. 23, the foot and toe protection device consoler (500) wherein the full length bottom comfort pad (1*a*) provides firm support to the arch and heel area, and offers additional reinforcement for the left and right wings (3) and (4) and added comfort for the pad of the foot.

In FIG. 23, the foot and toe protection device consoler (500) wherein, attached to the full length bottom comfort pad (1*a*) is the elevated arch support (17) which adds additional support for the arch.

Wherein, the elevated arch support (17) extends upwards from the full length bottom comfort pad (1*a*).

In FIG. 24, the full length bottom comfort pad (1*a*) provides a raised heel (18) area to provide additional support for the heel of the foot.

Also shown FIG. 24, the full length bottom comfort pad (1*a*) provides a sunken arch support cradle (1*b*) to provide additional support for the heel of the foot.

Wearing the foot and toe protection device consoler (500) simply requires sliding the foot into the foot and toe protection device consoler (500) and adjusting the left and right wings (3) and (4) shown in FIG. 23, on each side of the foot. Adjust the full length bottom comfort pad (1*a*) shown in FIG. 23, to comfortably fit on the metatarsal region of the foot and stretch to the length of the foot.

The toes support pad (2) shown in FIG. 23, should instantly adjust comfortably under the three middle toes when stretching the full length bottom comfort pad (1*a*) to the length of the foot. The arch support (17) should comfortably fit at the arch of the foot, and the foot should sit comfortably in the arch support cradle (1*b*).

Figure 25:
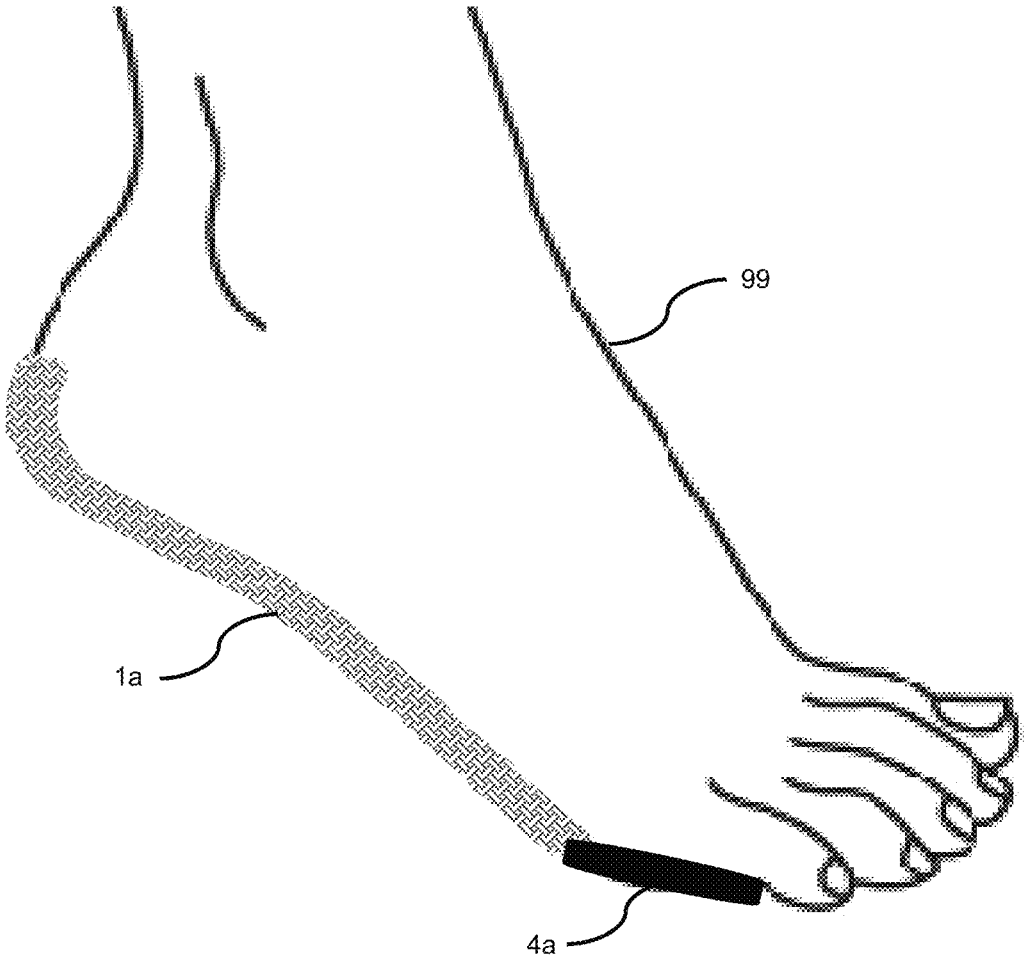
FIG. 25 is a perspective side view of the present invention in an alternate embodiment having a full length foot pad in use on the right foot.

FIG. 25 is a perspective side view of the foot and toe protection device consoler (500) in use from the right side of the right foot (99).

In FIG. 25, the full length bottom comfort pad (1*a*) is shown in shadowed texture for emphasis in the drawing; and the left and right wings (4*a*) is shown in black for emphasis in the drawing.

Figure 26:
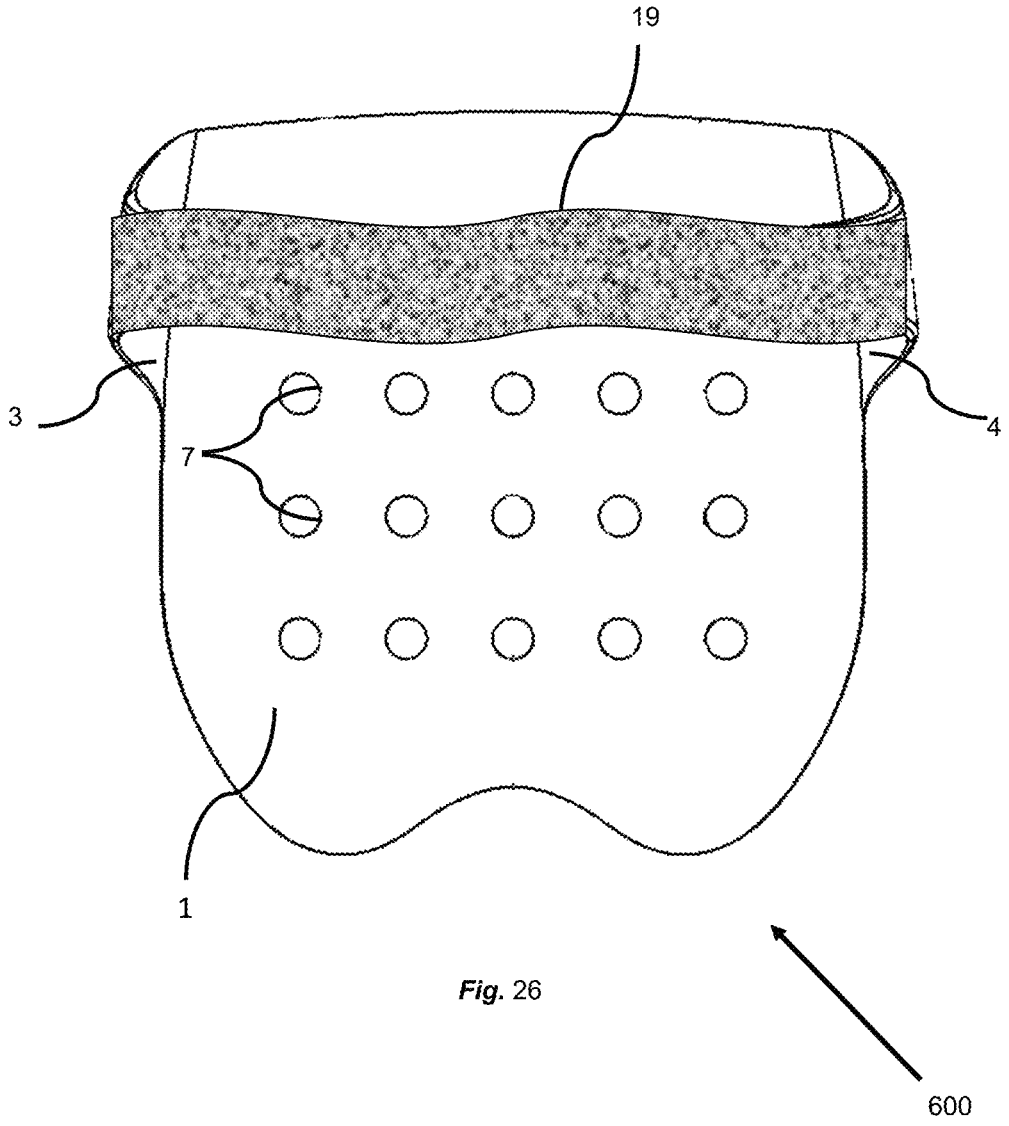
FIG. 26 is a perspective view of the present invention in an alternate embodiment having a decorative front made of lace or other decorative material.

Another alternate embodiment shown in FIG. 26 shows a zoomed-in top perspective view of the foot and toe protection device (100) with a decorative lace front. This embodiment will herewith be referred to as foot and toe protection device decorative (600).

The descriptions previously stated for FIG. 1 and FIG. 2 will not be restated in describing FIG. 26. The descriptions stated for FIG. 26 will describe the alternate embodiment parts of the invention for the foot and toe protection device decorative (600) as an extension of foot and toe protection device (100).

Referring in particular to FIG. 26 herein the foot and toe protection device decorative (600) comprising of several parts: a. the foot and toe protection device (100) as the base, and b. the decorative front (19).

In FIG. 26, wherein the decorative front (19) adds an additional aesthetic, fashionable, and stylish appeal to the foot and toe protection device decorative (600).

Wherein, the decorative front (19) may be made of a lace material and also can be made in various fashionable and stylish designs and materials, patterns and colors, images, beads or jewels, and various hues to blend with the user's skin-tone, to enhance the appeal and allow the user to coordinate with their attire.

Wherein, the decorative front (19) stretches across the top of the wearer's foot connecting to the left and right wings (3) and (4) of the foot and toe protection device (100).

The decorative front (19) is joined on the top left and right sides of the foot and toe protection device (100).

Figure 27:
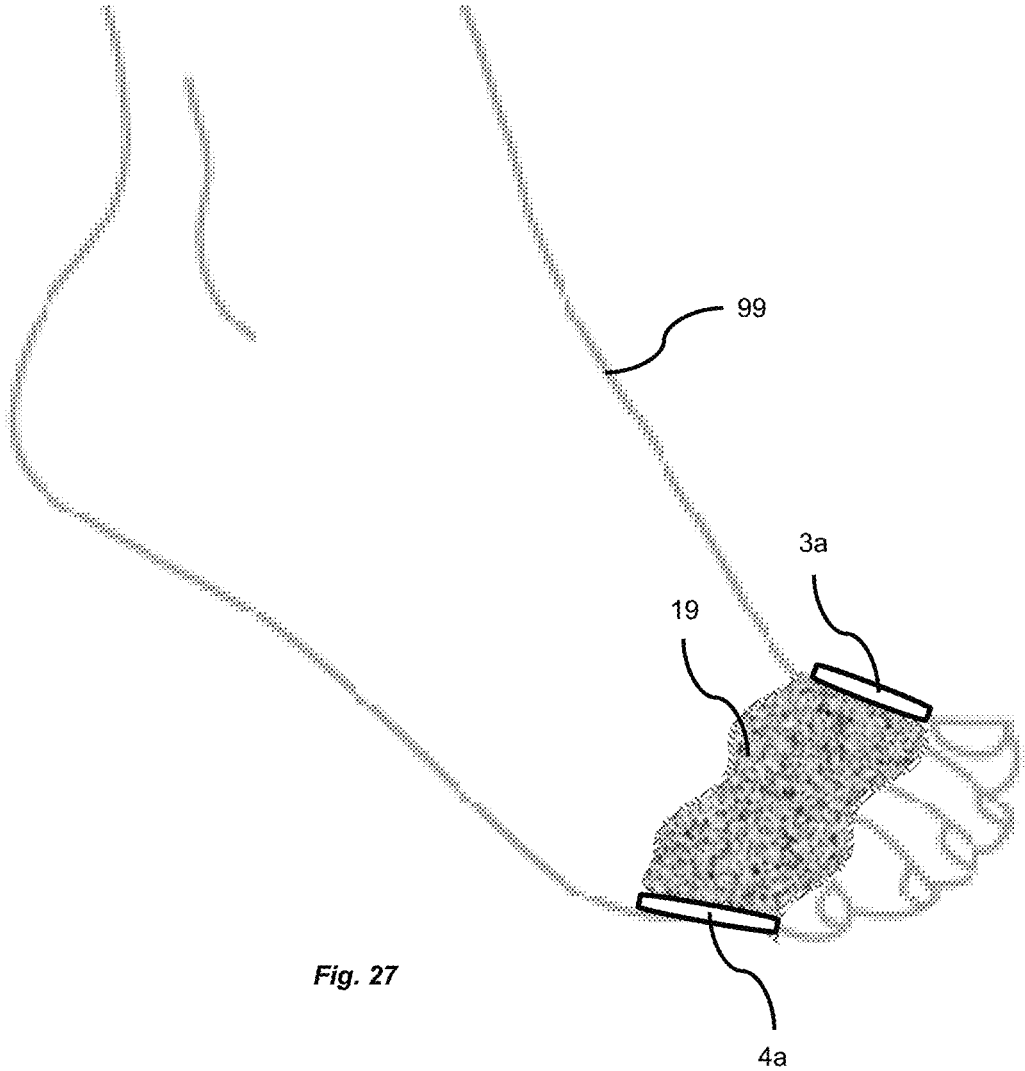
FIG. 27 is a perspective side view of the present invention in an alternate embodiment having a decorative front made of lace or other decorative material in use on the right foot.

FIG. 27 is a perspective side view of the foot and toe protection device decorative (600) in use from the right side of the right foot (99).

In FIG. 27, wherein, the decorative front (19) is shown extended across the top of the wearer's foot connecting to the left and right wings (3) and (4) of the foot and toe protection device (100).

In FIG. 27, the foot and toe protection device decorative (600) is shown in shadowed texture for emphasis in the drawing.

Wearing the foot and toe protection device decorative (600) simply requires sliding the foot into the foot and toe protection device decorative and adjusting the left and right wings (3) and (4) of the foot and toe protection device (100) shown in FIG. 27, on each side of the foot. Adjust the decorative front (19), on the top of the foot such that the decorative front (19) substantially covers an area of the front portion and top portion of the foot (99).

These additional embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A foot and toe device which may be slipped on a foot of a user prior to insertion of the foot in a footwear or it may be placed previously in a footwear before foot insertion for protection and comfort of a ball of the foot, a left and right side of the foot, a forefoot area of the foot, a top of the foot, a toe webspace of the foot, a back heel of the foot, a bottom arch of the foot, a bottom heel of the foot, a bottom of the foot, a great toe, a second toe, a pinky toe of the foot and a remaining number of toes, the device comprising:

a. a bottom comfort pad in the shape and general size of a ball of the foot which is flexible and can stretch to a general width of the foot;

b. a left wing and a right wings extending upwards from a bottom of the bottom comfort pad which are flexible and can stretch to adjust to the left and the right side of the foot;

c. wherein the left and right wings act as a reinforcing mechanism extending a distance that covers and secures the plurality of toes of the foot;

d. non-skid bumps located on a bottom surface of the bottom comfort pad which prevents the foot from sliding forward when inserted into a footwear which could cause the toes to extend over a front of the footwear;

e. the device being formed of a breathable and transparent elastomeric gel-like material;

f. wherein the footwear is a closed toe shoe, an open toe shoe, a sandal, or other similar footwear having a thong or toe separator between the great toe and the second toe;

g. wherein the wing is in contact with the pinky toe and prevents the pinky toe from protruding and bulging from a side of the footwear;

h. wherein the device does not include the use of any adhesives to directly attach the device to the foot or the footwear;

i. holes located in the bottom comfort pad which allow air to flow between the bottom comfort pad and the ball of the foot to allow the foot to breath;

j. the left and right wing having an interior and exterior side of the wing; wherein the interior side of the wing is in direct contact with the foot and the exterior side of the wing is in direct contact with the footwear;

wherein when the foot is inserted in the footwear and the ball of the foot comes in contact with the bottom comfort pad, it provides a cushion between the ball of the foot and the footwear for ease of walking and standing.

2. The foot and toe device of claim 1 further comprising:

buttons located on the exterior side of the wings, said buttons comprising:

a. a perpendicular small post portion attached to and slightly raised from an exterior side of the wings on a first end of a perpendicular small post portion;

b. a small rounded top attached to and slightly raised from a second end of a perpendicular small post portion.

3. The foot device of claim 2 further comprising:

a strap comprising:

a. a main center mass, which is flexible and can stretch a general width across a top of the foot;

b. a first end and second end of the main center mass;

c. a rounded flat tip on each of the first end and second end of the main center mass;

d. a small round buttonhole in a center of the rounded flat tip;

wherein, said small round buttonhole is adapted to engage with and receive one of the buttons on the exterior of the wings;

wherein the strap for use across a top of the foot serves as a mechanism to add relief of pain due to footwear pressure across a top of the foot when the foot is inserted into the footwear.

4. The foot and toe device of claim 2 further comprising:

a heel strap comprising:

a. a main center mass, which is flexible and can stretch from the left to the right side of the foot around a top heel of the foot;

b. a first end and second end of the main center mass;

c. a rounded flat tip on each of the first end and second end of the main center mass not to exceed a general diameter;

d. a small round buttonhole in the center of the rounded flat tip;

wherein, said small round buttonhole is adapted to engage with and receive one of the buttons on the exterior of the wings;

wherein the heel strap for use around the top heel of the foot serves as a mechanism to add relief of pain due to footwear pressure around the top heel of the foot when the foot is inserted into the footwear.

5. The foot and toe device of claim 2 further comprising:

a dual strap comprising:

a. a wide band, which is flexible and can stretch a general width across the top of the foot;

b. wherein the left and right side of the wide band both include two elongated straps;

c. wherein two elongated straps located on a respective side are separated by an arched-shaped spacing between the straps on the same side;

d. wherein each strap includes an end;

e. wherein the end includes a rounded flat tip;

f. a small round buttonhole in each of the center of the rounded flat tips;

wherein, each of said small round buttonholes are adapted to engage with and receive one of the buttons on the exterior of the wings;

wherein the wide band for use across a top of the foot serves as a mechanism to add relief of pain due to footwear pressure across a top of the foot when the foot is inserted into the footwear.

6. The foot and toe device of claim 1 further comprising:

a. a center strap that can stretch the general width across the forefoot area of the foot at a point near the toes of the foot;

b. the left and right wing are joined together by the center strap forming a loop over the forefoot area of the foot at the point near the toes of the foot;

wherein the center strap when stretched across the forefoot area of the foot at the point near the toes of the foot serves as a mechanism to add relief of pain due to footwear pressure across the forefoot area of the foot at a point near the toes when the foot is inserted into the footwear;

wherein the center strap, the bottom comfort pad, and the left wing and right wing together form a continuous device, securing the device to the foot;

wherein said center strap may be made of, but not limited to, a fabric material or various patterns, colors, or beads and jewels as long as the material stretch and flexibility is maintained.

7. The foot and toe device of claim 6 wherein when the footwear is in the form of the sandal or similar footwear having the thong or toe separator between the great toe and the second toe of the foot the device further comprises:

a. an intermediate post having a crescent-like curvature extending perpendicular between a first end and a second end;

b. the first end of the intermediate post attached to the center strap;

c. the second end of the intermediate post attached to the bottom comfort pad;

d. the intermediate post having an interior and exterior side, whereas the interior side is in direct contact with the foot and the exterior side is in direct contact with the thong-type sandal or other similar footwear comprising a thong or toe separator between the great toe and the second toe of the foot;

e. wherein the attachment of the center strap to the first end of the intermediate post, and the intermediate post second end attachment to the bottom comfort pad forms a loop having a first size adapted to insert the great toe, and a second loop having a second size adapted to insert the remaining toes;

f. the second loop being larger than the first loop, allowing the intermediate post placement between the great toe and the second toe of the foot;

g. wherein, when the device is slipped on the foot of the user and the foot is inserted in the footwear, said thong or toe separator of said footwear shall rest in the crescent-like curvature of the intermediate post;

wherein an intermediate post fitted between the great toe and the second toe serves as a mechanism to add relief of pain due to footwear pressure of the toe webspace from the the thong or toe separator between the great toe and the second toe of the foot when the foot is inserted into the footwear;

wherein the bottom comfort pad, the left wing and right wing, the center strap, and the intermediate post together form a continuous device, securing the device to the foot;

wherein said center strap may be made of, but not limited to, a fabric material or various patterns, colors, or beads and jewels as long as the material stretch and flexibility is maintained and the intermediate post is formed of a breathable and transparent elastomeric gel-like material.

8. The foot and toe device of claim 1 further comprising;

a. wherein the bottom comfort pad is elongated in the shape and general size of the bottom of the foot which is flexible and can stretch to a general length of a bottom of the foot;

b.

c. a bottom arch of foot support pad attached to and slightly raised from the bottom comfort pad, the bottom arch of foot support pad being flexible and provides cushioning under the bottom arch of the foot for comfort;

d. the bottom comfort pad, having a ball of the foot front end and a back heel back end;

e. a lift portion attached to and slightly raised from the back heel back end of the bottom comfort pad to provide additional support for the bottom heel of the foot;

f. a heel a heel rest portion slightly sunken at the back heel back end of the bottom comfort pad to provide a resting area for the bottom heel of the foot;

g. the elongated bottom comfort pad, the bottom arch of foot support pad, the heel lift portion, and the heel rest portion together form a continuous device;

wherein the bottom comfort pad, the bottom arch of foot support pad, the heel lift portion, and the heel rest portion serve as a mechanism to add relief of pain due to footwear pressure on the bottom of the foot, the bottom arch of the foot, and the bottom heel of the foot when the foot is inserted into the footwear.

9. The foot and toe device of claim 1 further comprising:

a toe support pad attached to and slightly raised from a bottom comfort pad, the toe support pad being flexible and provides cushioning under the toes for comfort and ease of walking.

10. The foot and toe device of claim 1 further comprising:

One or more strap members which is repeatedly selectively attachable and detachable by way of an attachment means to the left and right wings to provide further comfort to the user during use of the device.

* * * * *